United States Patent [19]

Sato

[11] 4,057,452

[45] Nov. 8, 1977

[54] CONSTANT PRESSURE MECHANISM FOR HAND LABELER

[75] Inventor: Yo Sato, Tokyo, Japan

[73] Assignee: Kabushiki Kaisha Sato Kenkyusho, Tokyo, Japan

[21] Appl. No.: 720,225

[22] Filed: Sept. 2, 1976

[30] Foreign Application Priority Data

Sept. 5, 1975 Japan ..... 50-107120

[51] Int. Cl.[2] ..... B41F 1/08; B41F 1/38; B41F 1/44

[52] U.S. Cl. ..... 156/384; 101/288; 101/292

[58] Field of Search ..... 156/277, 384, 540, 541, 156/542, 584, DIG. 24, DIG. 33, DIG. 37, DIG. 48, DIG. 42, 577, 579; 101/287, 288, 291, 292, 316

[56] References Cited

U.S. PATENT DOCUMENTS

| | | | |
|---|---|---|---|
| 3,265,553 | 8/1966 | Kind et al. | 156/384 |
| 3,420,172 | 1/1969 | Kaplan | 101/291 |
| 3,601,047 | 8/1971 | Waibel | 101/287 |
| 3,880,078 | 4/1975 | Pelet | 101/288 |

*Primary Examiner*—Caleb Weston
*Attorney, Agent, or Firm*—Ostrolenk, Faber, Gerb & Soffen

[57] ABSTRACT

A constant pressure mechanism for a hand operated labeler to print the labels that are in a label strip clearly and precisely with a constant printing pressure applied to the labels irrespective of the strength and speed of the squeezing and releasing of the operator's hand lever; the mechanism comprises: a printing device fixed to the machine frame; a platen assembly supporting the label strip in opposition to said printing device; means operatively connecting the platen assembly and said hand lever, and banging the platen assembly against the type face of the printing device with a predetermined spring force and then retracting the platen assembly to its original position.

31 Claims, 29 Drawing Figures

CONSTANT PRESSURE MECHANISM FOR HAND LABELER

BACKGROUND OF THE INVENTION

This invention relates to a constant printing pressure mechanism for a hand operated labeler for clearly and precisely printing the labels on a label strip irrespective of the strength and speed of the squeezing and releasing of the hand lever or the trigger of the labeler. Further, the constant pressure mechanism of the present invention is used in a hand labeler of the type which imprints ordinary numerals or marks or OCR (optical character recognition) letters or bar codes on the labels of a label strip. The label strip is comprised of a carrier strip coated with a releasing agent on its surface and a chain of same sized labels coated with pressure-sensitive adhesive on their rear surfaces and affixed on the surface of the carrier strip. Squeezing and releasing of the hand lever not only imprints labels, it also peels the printed labels from the carrier strip so that they may be applied on the surfaces of desired articles.

In the operation of the conventional hand labelers, the printing pressure of the type face against the label surface varies according to the manual force applied upon squeezing of the hand lever and upon the speed of a squeeze. The quantity of ink applied to the label surface by the type face varies in each imprinting operation, depending on the printing pressure and the duration of one squeezing of the hand lever. Therefore, labels could not be consistently printed with clear and balanced letters by using the conventional hand labelers.

For example, in the hand labeler disclosed in U.S. Pat. No. 3,265,553, a hand lever is pivotally attached to the hand grip that is integrally formed on the rear portion of the machine frame, while the front portion of the hand lever is integrally provided with a yoke carrying a printing device. The printing device is vertically moved toward the label together with the yoke as the hand lever is squeezed. Depending upon how strongly the hand lever is squeezed each printing stroke, the printing pressure of the type face against the label surface correspondingly varies. Furthermore, when the duration of each squeezing operation is different, the quantity of ink applied to the label surface varies, even when the printing pressure is constant. Therefore, clear, precise, predictable printing on labels cannot be expected.

Furthermore, in the hand labeler disclosed in Federal Republic of Germany Offenlegungsschrift DT-OS No. 1,909,900, a printing device is affixed to the machine frame and a press platen to press labels against the types of a printing device is attached to the front portion of rocking levers formed separately from the hand lever. When the hand lever is squeezed, the press platen is raised and the label on the platen is forced against the types. When the hand lever is released, the press platen is lowered. Therefore, like the above-mentioned hand labeler of U.S. Pat. No. 3,265,553, because the hand lever is squeezed with varying force, the printing pressure of the printing device against the label changes during each imprinting. In addition, the quantity of ink transferred varies with the duration of a squeeze of the hand lever, even when the printing pressure is not changed. Therefore, clear and precise label printing cannot also be expected by this hand labeler.

In the hand labeler disclosed in U.S. Pat. No. 3,420,172, the hand lever pivots relative to the grip which is integral with the machine frame. An inking roller is attached to the upper extension of the hand lever. The supporting arm of the printing head is pivotally attached to the upper portion of the machine frame. The printing head is pressed toward the labels on the platen by the tension of a spring. When the hand lever is squeezed, a cam formed on the upper end of the hand lever contacts the follower of the inking roller supporting arm, and ink is applied to the type face of the printing head by the inking roller. At the same time, the printing head is pivoted up. When the hand lever is thereafter released, the printing head is forced down by the spring and the label is thus printed. According to this structure, the label is printed with the same printing pressure, independent of the squeezing force applied to the hand lever. However, the printing head is kept in contact with the label a vaying length of time, so that the quantity of ink transferred to the label differs according to the time period of such contact. Therefore, clear printing on the labels is not always expected with this apparatus. Further, in the hand labeler of this type, because the printing head moves downward as it prints, precise printing cannot be attained owing to the vibration of the printing head caused by its own weight and its motion.

Precise and clear imprinting of labels has never been attainable with the conventional hand labelers. However, such labelers could be used for ordinary purposes of printing only the visually recognizable numerals and letters on labels attached to merchandise in stores, and the like purposes. In these situations, even when the imprinted characters are somewhat unclear, imprecise, overinked, underinked or uneven, customers or cashiers can still read them without problem.

Recently, however, the employment of what is called POS (point of sales) control systems is gradually increasing, particularly in large stores. In a POS control system, OCR letters or bar codes indicating the maker, the item, colors, sizes, seasons, grades, materials, prices and the like are printed on labels. The printed labels are then applied to commodities such as clothing and foods. When the commodities are sold, the data printed on the attached labels are read and treated by an optical reader.

It is necessary that the OCR letters or bar codes be printed clearly and precisely in order that they be capable of being read by optical means. However, as disclosed in the foregoing, the conventional hand labelers are not suitable for printing such OCR letters and bar codes since the ink density and clarity of printing are different in each operation and the precision of printing is unsatisfactory.

BRIEF SUMMARY OF THE INVENTION

Thus, it is the primary object of the present invention to provide an improved hand labeler which is able to print characters clearly and precisely on labels, or the like.

A further object of the present invention is to provide a hand labeler which is suitable for printing OCR letters and bar codes adapted for optical reading as well as ordinary visually readable characters.

Still a further object of the present invention is to provide a mechanism for a hand labeler by which clear and precise printing of labels, or the like can be attained irrespective of the strength, speed or time length of squeezing of the hand lever of the labeler.

Yet a further object of the present invention is to provide a constant pressure mechanism for a hand labeler which is easy to manufacture and is reliable in operation.

To realize the above mentioned objects, an improved constant pressure mechanism is provided for being mounted in a hand labeler. The hand labeler which receives the mechanism is of the type which includes a hand lever that is squeezed relatively to a grip. The label strip on the labeler platen is forced into contact with the type face of a printing device. The printed label is peeled from its carrier and is applied on the surface of articles.

The constant pressure mechanism of the present invention comprises: a printing device fixedly mounted on the machine frame of the hand labeler; a platen assembly that carries a label strip and that confronts the type face of said printing device; and a means for operatively connecting said platen assembly and a hand lever, and for rapidly moving the platen assembly against the type face of said printing device together with said label strip, by means of springs, and for thereafter retracting the platen assembly from said type face.

Various embodiments of this constant pressure mechanism are disclosed. In each, the platen is on a lifting lever that is normally biased away from the imprinting type face. Engaging means for engaging and moving the platen lifting lever to the type face are provided. These engaging means are connected to move toward the platen lifting lever and to engage it as the manual actuating lever of the labeler is operated. Once the platen lifting lever is engaged, the engaging means for engaging and moving the platen lifting lever are disengaged from the manual actuating lever. Springs connected to these engaging means draw them back to their prior position before the actuating lever moved the engaging means. The engaging means, now in engagement with the platen lifting lever, moves it and raises the platen. Toward the end of the return stroke, the engaging means is separated from the platen lifting lever; and the platen completes its print stroke and is then returned to it start position by the platen return spring.

The foregoing and other objects and features of the present invention will become apparent from the following description taken in connection with the accompanying drawings.

BRIEF DESCRIPTION OF THE DRAWINGS

FIGS. 9 to 12 show the operative states of the constant pressure mechanism when the hand lever is squeezed, wherein FIGS. 9 and 10 are vertical cross-sectional views on the center plane of the labeler and FIGS. 11 and 12 are partially cross-sectional side elevational views where the side plate on the viewer's side is removed;

DETAILED DESCRIPTION OF THE PREFERRED EMBODIMENTS

With reference to the accompanying drawings, several embodiments of the present invention will be explained in detail.

Figure 1:
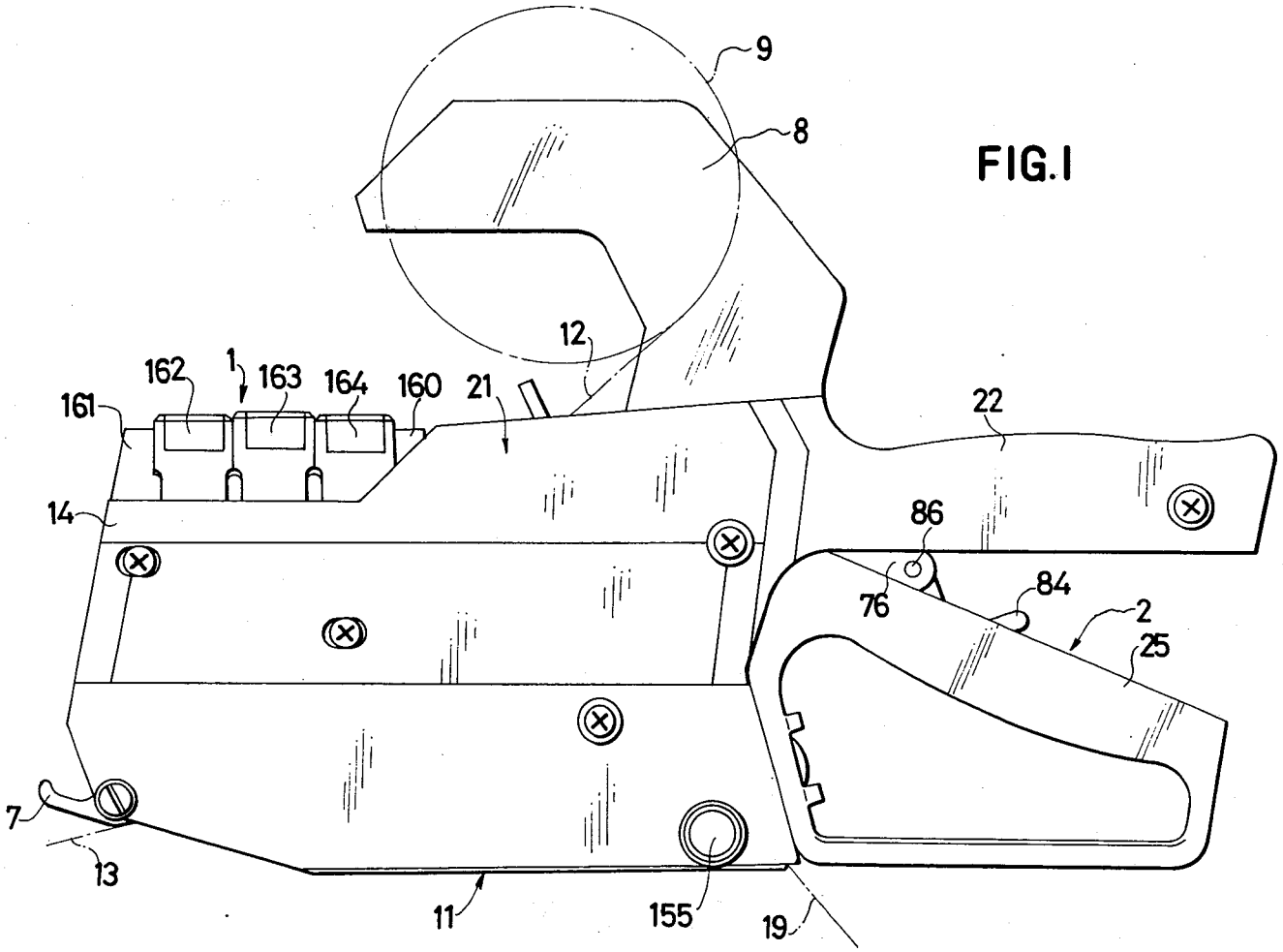
FIG. 1 is a side elevational view of a labeler containing the first embodiment of the present invention.
Figure 2:
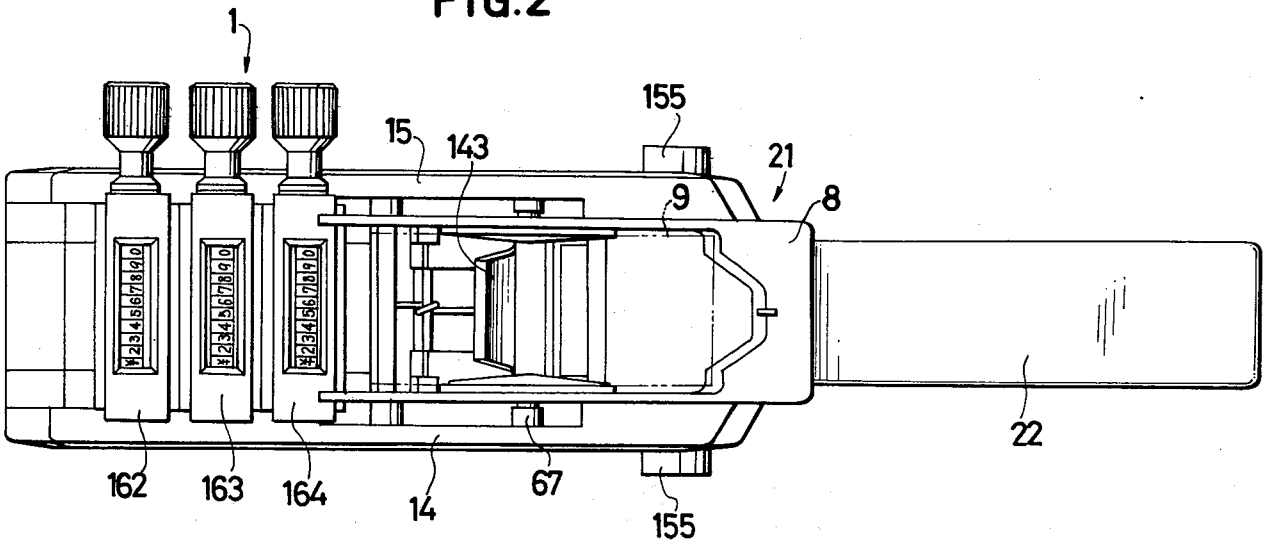
FIG. 2 is a plan view of this embodiment.
Figure 3:
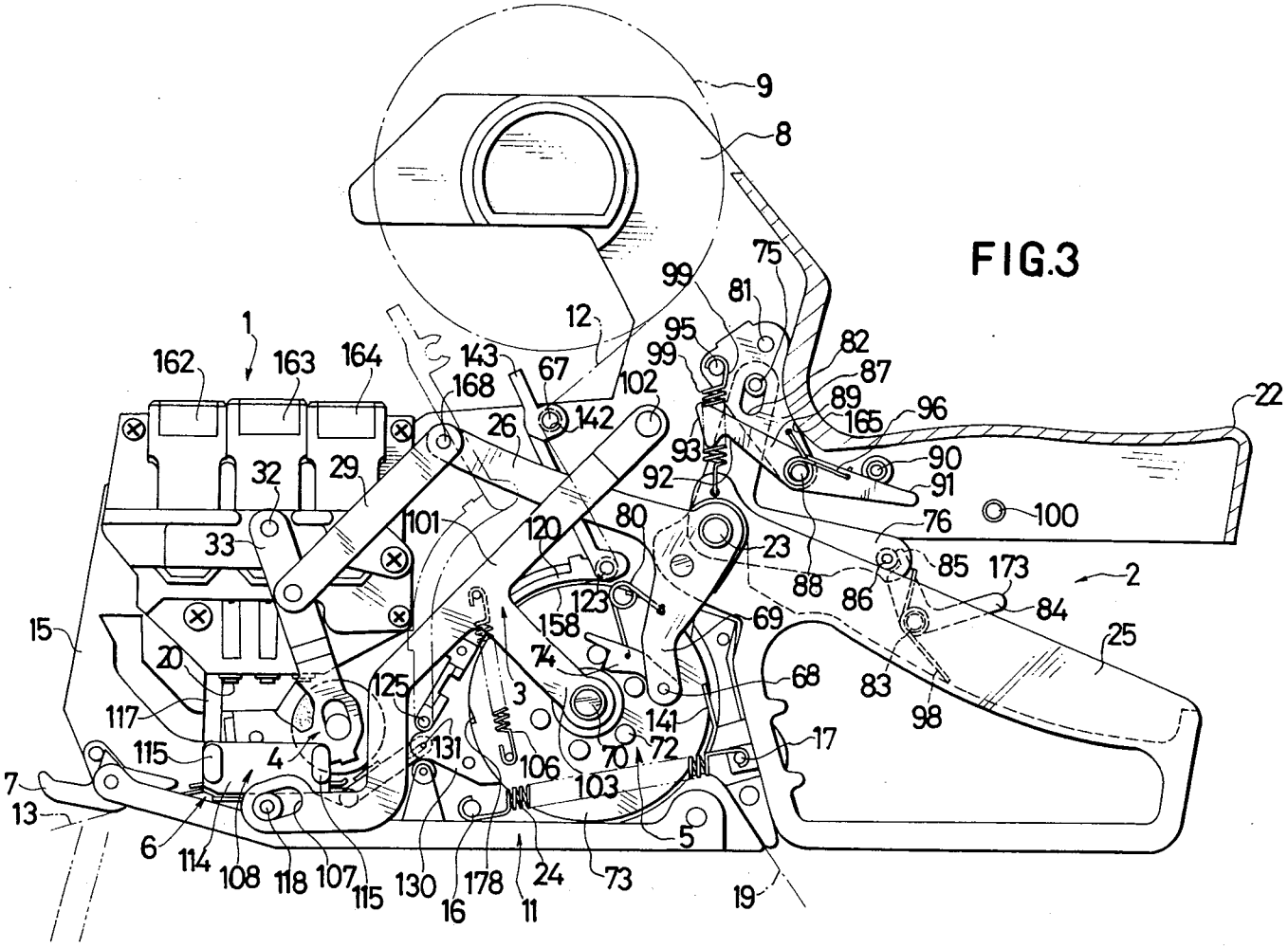
FIG. 3 is a side elevational view, partly in cross-section, of the hand labeler of FIG. 1, in which the side plate on the viewer's side of the labeler has been removed.

As shown in FIGS. 1–3, the machine frame 21 of the hand labeler containing the first embodiment of constant pressure mechanism comprises a pair of side plates 14 and 15 which are connected together by a number of below described shafts and pins.

The machine frame 21 has a printing device 1 affixed in the upper front (left-hand) portion and a driving mechanism 2, comprised of a stationary grip 22 and a pivotable hand lever 25 at the rear (right-hand) portion thereof. The machine frame 21 supports a constant pressure mechanism 3 at its middle portion, an inking device 4 for inking types of printing device 1 and located at the lower front portion of the machine frame, a peeling device 6 for separating labels from their backing strip, said device being located at a label strip advancing mechanism 5 at the lower middle portion of the machine frame, a peeling device 6 for separating labels from their backing strip, said device being located at the front bottom portion, a separated label applicator 7 at the front end of the bottom portion of the machine frame, and a label holder 8 for supporting a rolled label strip 9 and located at the upper middle portion of the machine frame.

Each of the above devices or mechanisms is now described.

PRINTING DEVICE

Figure 25:
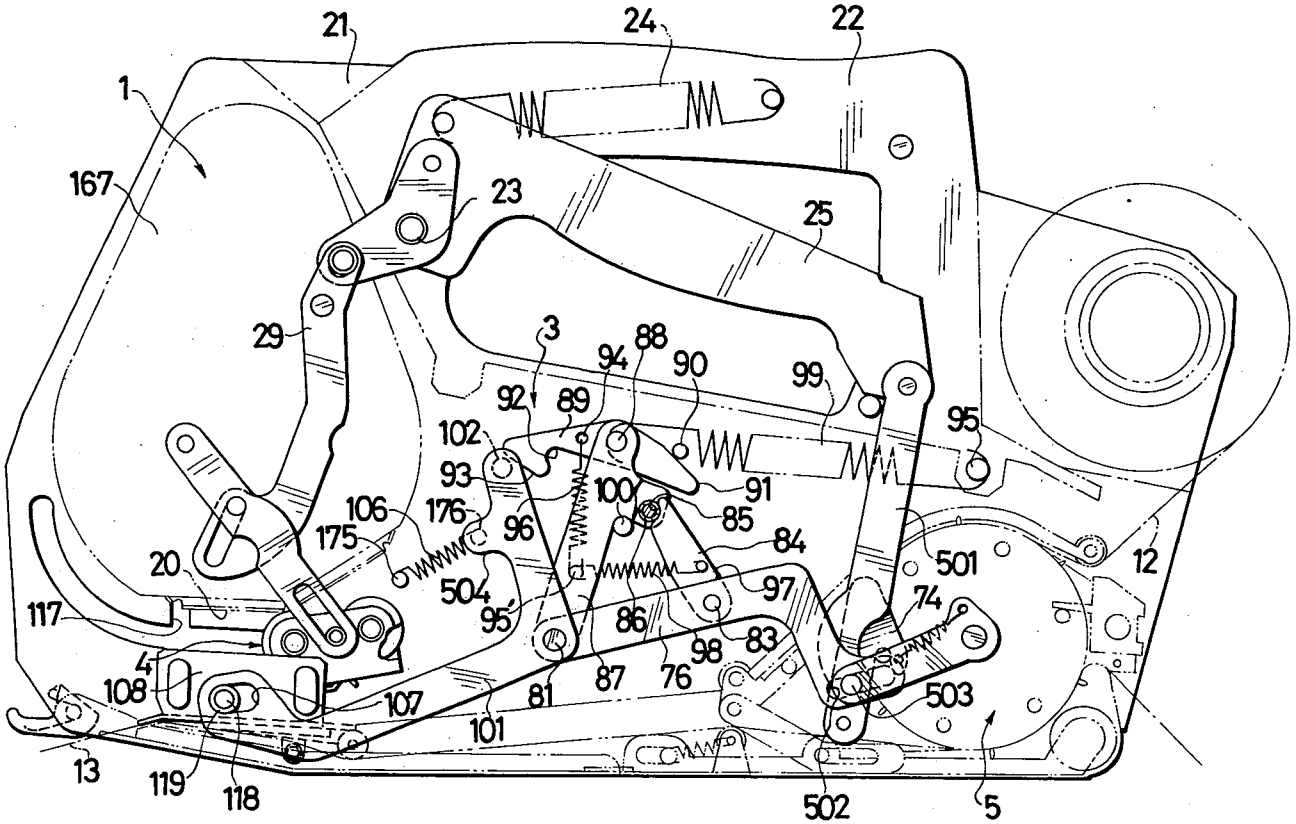
FIG. 25 is the same type of view as FIG. 19 with the labeler containing the fifth embodiment of the constant pressure mechanism.
Figure 26:
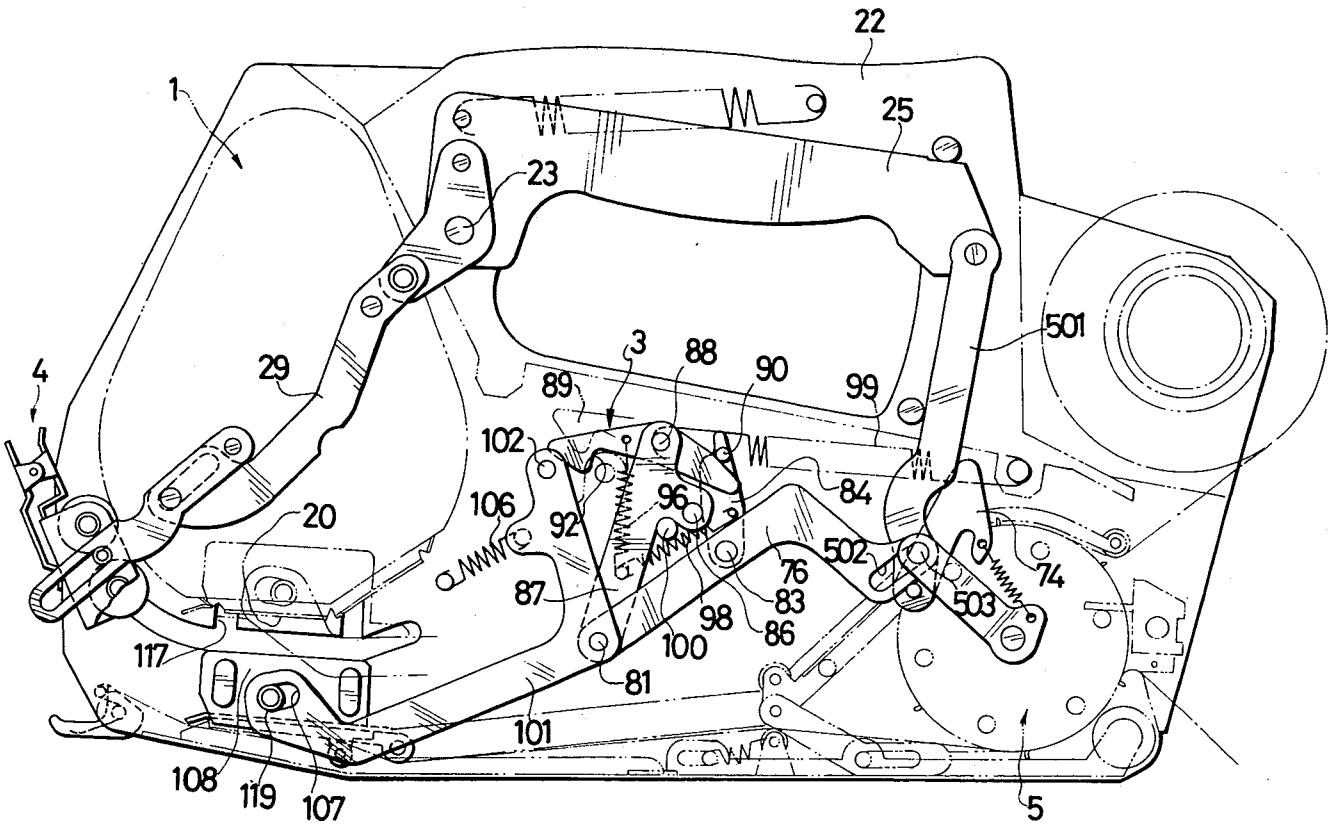
FIG. 26 is the same view as FIG. 25, wherein the hand lever has been squeezed.

There are two kinds of printing devices 1, one for printing ordinary or OCR letters and the other for printing bar codes. Printing devices of interest here are disclosed, for example, in U.S. Application Ser. No. 658,491, filed Feb. 17, 1976 and in U.S. Application Ser. No. 678,761, filed Apr. 21, 1976, both incorporated herein by reference. The printing devices 1 suggested for the third embodiment of FIGS. 21 and 22, the fourth embodiment of FIGS. 23 and 24 and the fifth embodiment of FIGS. 25 and 26, are typically used for printing bar codes, whereas the printing devices 1 for the other embodiments are designed for printing three lines or rows of OCR letters. The bar code printing devices 1 are provided with type rings and the OCR character printing devices are provided with type bands. Between the opposed frames 160 and 161 of the printing device 1, a bar code type ring assembly 167 or a type band assembly 162, 163, 164 is fixed and the type rings or type bands are movably supported in their assembly. The bottom portions of the type bands 162, 163 and 164, i.e. the sides thereof facing toward a print position and thus the type faces to be inked and to thereafter imprint a type face 20 in which a plurality of types are aligned for printing labels 13.

DRIVING MECHANISM

As shown in FIG. 3, the driving mechanism 2 includes the grip 22 and the hand lever 25. The grip 22 is integrally formed at the rear portion of the machine frame 21. The hand lever 25 is pivotally secured at the pivot 23 which is attached to the machine frame 21. The hand lever 25 can be pivoted relative to the grip 22. The hand lever 25 is urged clockwise in FIG. 3 by a tension spring 24 stretched between a spring pin 16 attached to the lower portion of the machine frame 21 and another spring pin 17 integrally formed on the hand lever 25.

Figure 5:
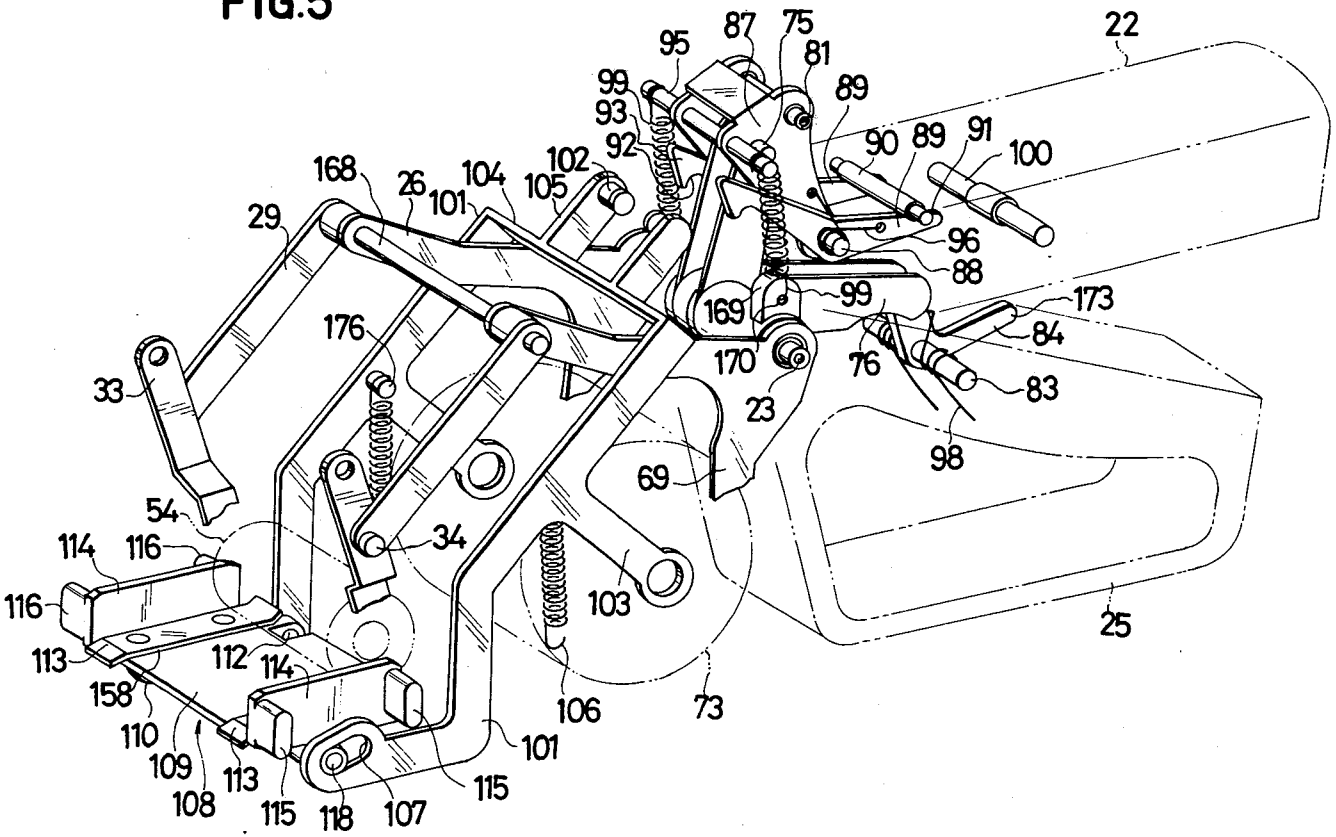
FIG. 5 is a perspective view of the first embodiment of the constant pressure mechanism.

As shown in FIG. 5, attached to the front portion of the hand lever 25 is a bifurcated yoke 26. The front (left-hand) end of the yoke 26 is pivotally connected to driving levers 29 by a pivot pin 168. The forward ends of the driving levers 29 are pivotally connected to rocking levers 33 by pivot pins 34. The rocking levers 33 are pivotally attached to the fixedly located printing device 1 by pins 32.

Extending downwardly from each arm of the yokes 26, there is a driving lever 69 for driving the advancing mechanism 5. A hook 74 is pivotally attached to the lower end of each driving lever 69 by a pivotable hook pin 68. The hook 74 is urged counterclockwise by a tensioned torsion spring 80 that is attached to both the hook 74 and the driving lever 69.

CONSTANT PRESSURE MECHANISM

The function of the constant pressure mechanism 3 shown in FIGS. 3 to 12, is to prevent the label printing pressure from fluctuating. This constant pressure mechanism 3 is mainly comprised of the lifting member 84, first lifting pawl levers 76, second lifting pawl levers 87, lifting pawls 89, lifting springs 99, platen lifting levers 101 and platen assembly 108.

The L-shaped lifting member 84 is pivotally attached at the upper middle portion of the hand lever 25 by a pin 83 and it is urged counterclockwise by the tensioned torsion spring 98 which extends between abutments on grip 25 and member 84. A recess 85 is formed at the upper forward end of the lifting member 84. When the hand lever 25 is completely squeezed upwardly to the grip 22, the rear end 173 of member 84 engages and is pushed down by a stop pin 100 formed on the grip 22. Thus, the lifting member 84 is turned clockwise.

The L-shaped first lifting pawl levers 76 are pivotally secured at their bends to the machine frame 21 at the hand lever pivot 23. Levers 76 are provided with a supporting rod 86 at the end of their rear legs and with a connecting pin 75 at the end of their upper leg. In the usual condition of the labeler, with the hand lever released, the supporting rod 86 is held in the recess 85 of the lifting member 84. When the hand lever 25 is completely squeezed toward the grip 22, the rear end 173 of the lifting member 84 contacts the stop pin 100 and the member 84 is turned clockwise. This releases the engagement between the supporting rod 86 and the recess 85.

Figure 7:
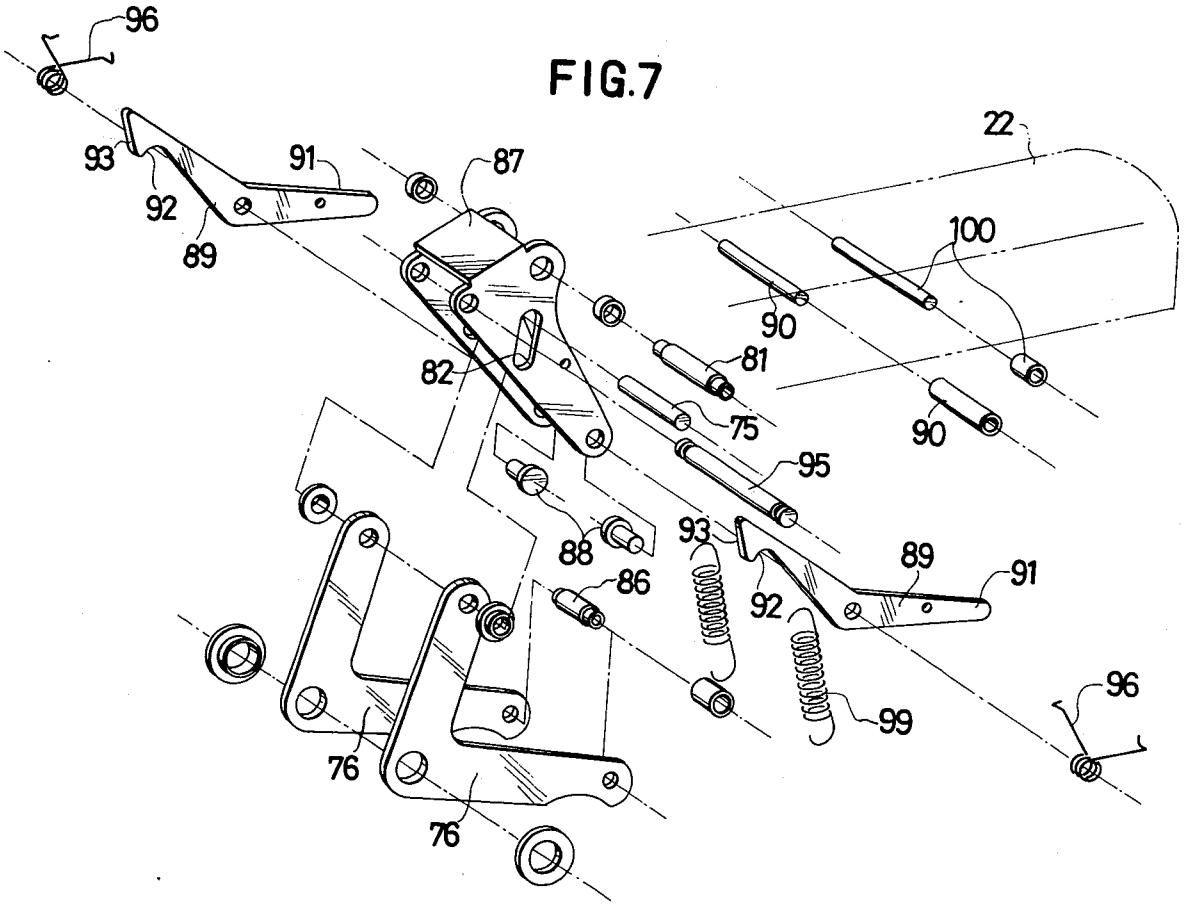
Figure 8:
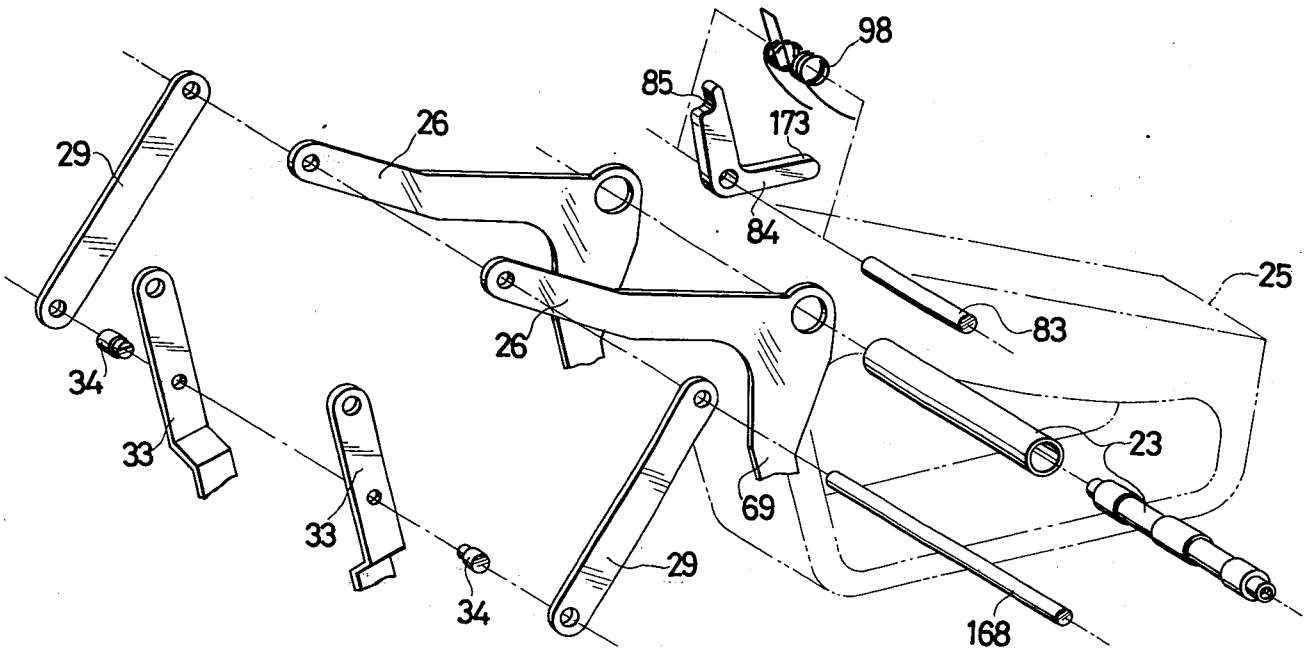

The upper portions of the second lifting pawl levers 87 are pivotally secured to a shaft 81 fixedly attached to the machine frame 21. The lower portions of the levers 87 are provided with pins 88, to which the central portions of lifting pawls 89 are pivotally attached. As shown in FIG. 7, vertically elongated slots 82 are formed in the middle portions of the second lifting pawl levers 87. A pin 95 is attached to the upper front corners of said levers 87. The connecting pin 75 of the first lifting pawl levers 76 is inserted into slots 82. A pair of lifting springs 99 are attached between the pin 95 and the small holes 170 formed in the projections 169 at the upper front end of the hand lever 25 (FIG. 5). The second lifting pawl levers 87 are thereby urged counterclockwise about the fixed shaft 81. However, the counterclockwise rotation of the levers 87 is stopped by the inside surface 165 of the grip 22.

The lifting pawls 89 have rear inclined surfaces 91 which are in contact with a second stop pin 90 affixed in the grip 22. The front portions of the pawls 89 are provided with front inclined surfaces 93 and hooks 92 just behind surfaces 93. Further, torsion springs 96 are wound around the lifting pawl pins 88. One end of the springs 96 is hooked on the second lifting pawl levers 87 while the other end is hooked on the lifting pawls 89. The lifting pawls 89 are normally urged counterclockwise.

Figure 6:
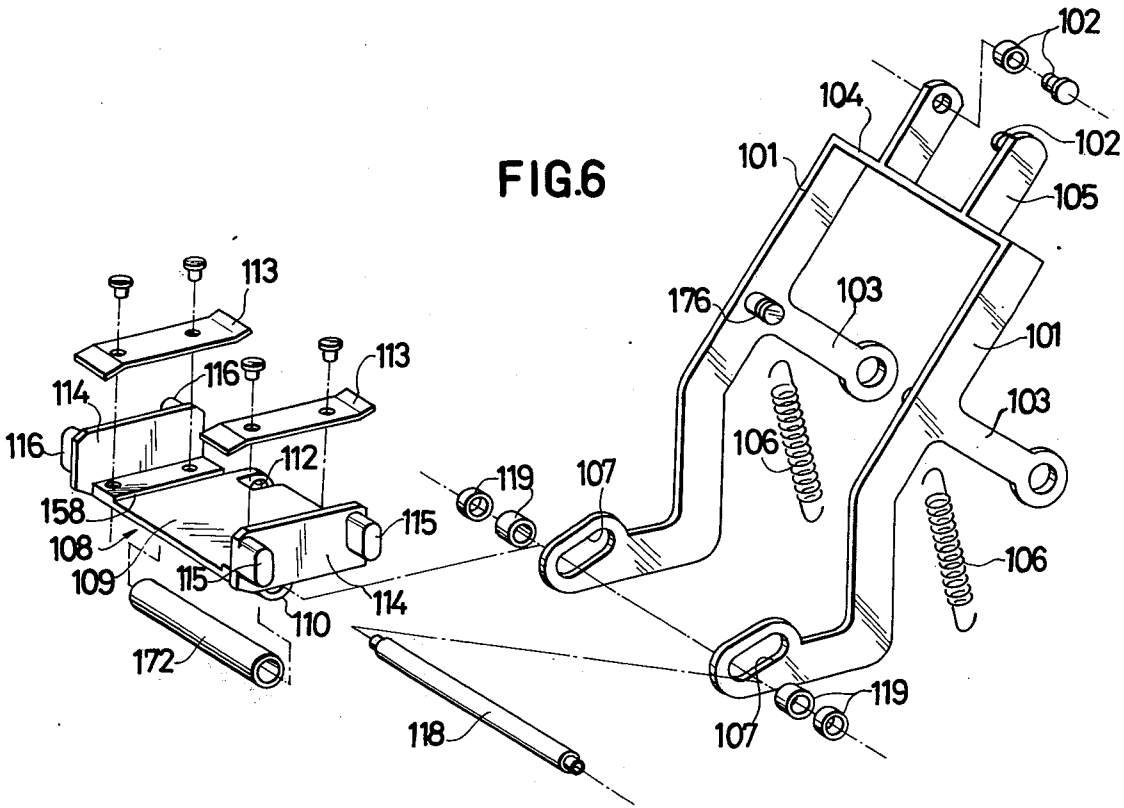
FIGS. 6, 7 and 8 are exploded perspective views of different sections of the constant pressure mechanism shown in FIG. 5.

As shown in FIGS. 3, 5 and 6, the generally T-shaped, parallel and spaced apart lifting levers 101 are connected together by a connecting plate 104 which is provided with a pair of integral upwardly and rearwardly projecting extensions 105. The upper end of each extension 105 is provided with a hook pin 102. In order to support the below mentioned platen assembly 108, horizontally elongated slots 107 are formed in the lower end portions of platen lifting levers 101. The lower ends of the perpendicular legs 103 of the platen lifting levers 101 are pivotally secured to the main shaft 70, which is attached to the machine frame 21. At the base of legs 103, inwardly facing pins 176 are fixed. Extending between the pins 176 on legs 103 and other pins 175 on the machine frame 21, there are a pair of tension springs 106 so as to urge the platen assembly 108 downwardly and to urge the levers 101 counterclockwise, thereby to bias the platen assembly 108 away from the type face 20.

The platen assembly 108 comprises a platen 109 for supporting the label strip 12 and upstanding side walls 114 attached on both sides of the platen 109 so as to form a channel like frame for guiding the label strip.

A joint hole 112 is formed in the lower rear portion of the platen 109. Along both side edges of the platen 109, there is a pair of label guide plates 113 attached to the side edges of the platen so that they extend over the platen at a short distance above the platen. The width between the inner edges of said label guide plates 113 is slightly smaller than the width of the label strip 12 and it corresponds to the width of the type face 20. The plates 113 define passages 158 in which the clearance is slightly larger than the thickness of label strip 12. Thus, all four sides, top, bottom, right and left sides, of the label strip 12 are held and guided through said passage 158. When printing is performed, a label 13 of label strip 12 which is on the platen 109 is brought into contact with the type face 20 by the vertically upward movement of the platen 109.

Further, on the exteriors of both side walls 114, two pairs of parallel projections 115 and 116 are integrally formed. They slidingly fit into vertical grooves 117 formed on the inside surfaces of the machine frame side plates 14 and 15.

As shown in FIG. 6, bearings 110 are integrally formed on the undersurface of the platen assembly 108. A stepped support pin 118 is inserted through the interior rings 119 and bearings 110. At both ends of the support pin 118, another pair of rings 119 are loosely fitted so that there is a respective ring 119 on each side of each bearing 110. These outer rings 119 are placed into the slots 107 of the platen lifting levers 101. In order to prevent the rings 119 from sliding off, a sleeve 172 is loosely fitted over the support pin 118 between the bearings 110.

INKING DEVICE

The inking device is a variation on the inking device shown in my copending U.S. application Ser. No. 716,934, filed Aug. 23, 1976, entitled "Ink Supply Devices for Portable Labeling Machine".

Figure 13:
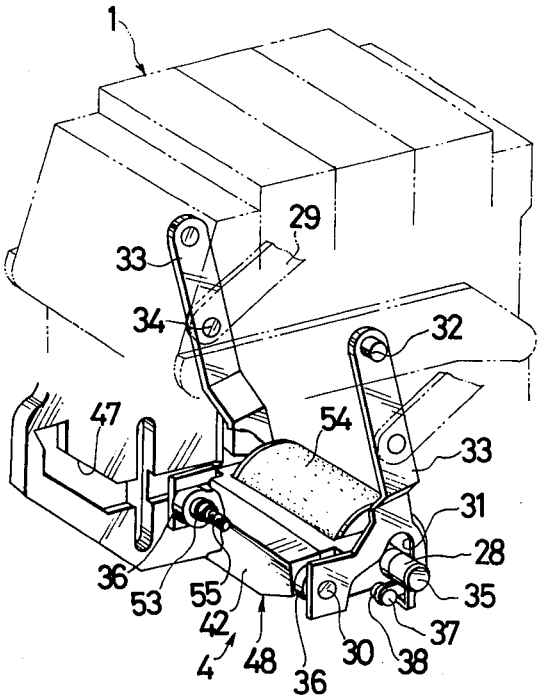
FIG. 13 is a perspective view of an inking device used with the labeler.
Figure 14:
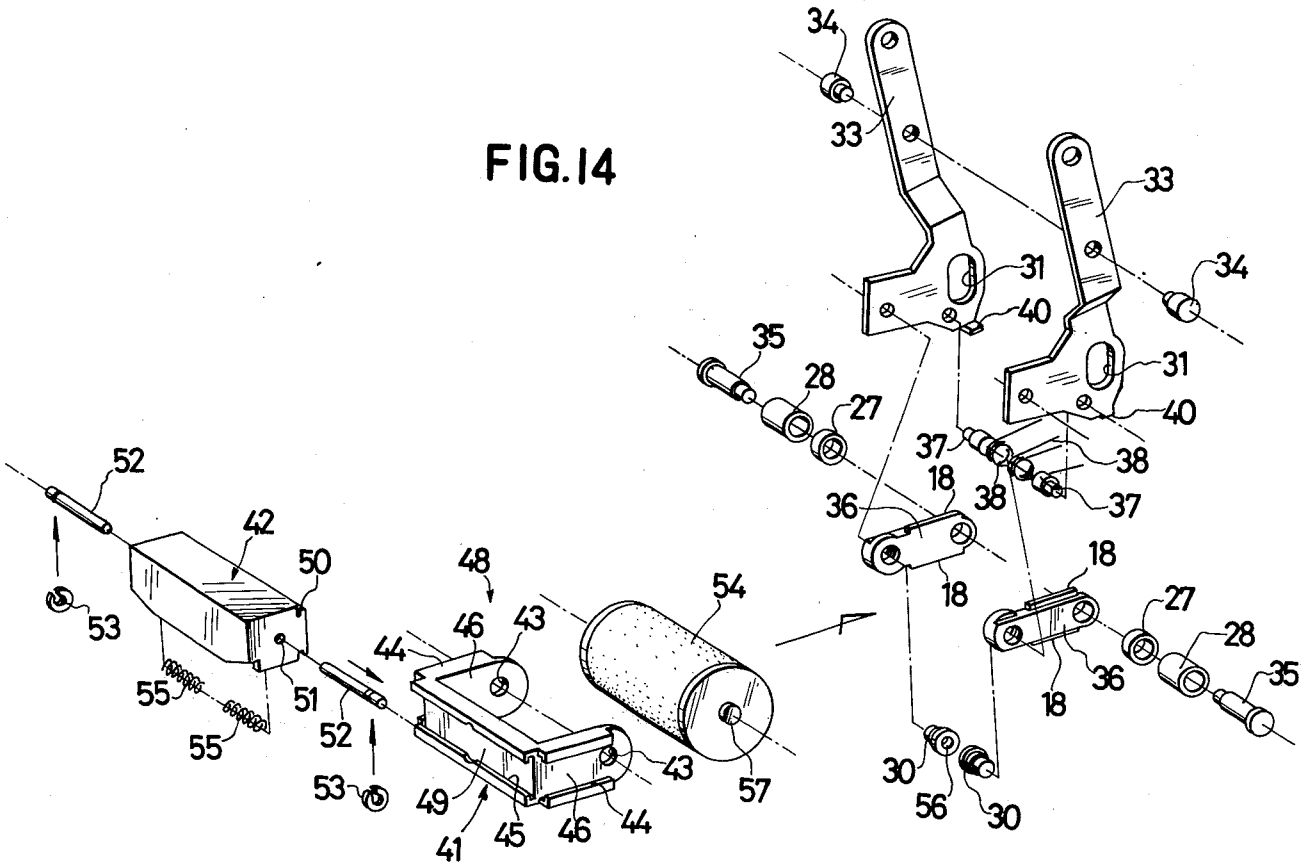
FIG. 14 is an exploded perspective view of the inking device of FIG. 13.

The inking device 4 for applying ink to the type surface 20 of the printing device 1 is shown in detail in FIGS. 13 and 14. The inking device mainly comprises an ink roller assembly 48, supporting members 36 for supporting the assembly 48, rocking levers 33 and horizontally extending long grooves 47 formed on the front inside surfaces of the machine frame 21. The ink roller assembly 48 comprises an ink impregnated inking roller 54, an ink roller supporting cartridge frame 41 and a cartridge frame holder 42.

The rocking levers 33 have slots 31 in their lower portions and they are pivotally secured to the machine frame 21 at their upper ends by pins 32. The pins 34 attached to the middle portions of the levers 33 are connected to the front ends of the above noted driving levers 29. The rocking levers 33 can be pivoted around the pins 32 attached to the machine frame 21 by the action of the driving levers 29.

The supporting members 36 have upper and lower narrow width lugs 18. The members 36 have upper and lower narrow width lugs 18. The members 36 are pivotally attached to the rocking levers 33 by pins 30. The movable rearward ends of the supporting members 36 are provided with rings 27 and 28 which are secured to the members 36 by pins 35. The rings 27 are loosely fitted into the slots 31 of the rocking levers 33 and can move along these slots. The other ring 28 thrust out of the rocking levers 33 and are received within the long grooves 47 formed on the machine frame 21. The long grooves 47 have a slightly larger width than the outer diameter of said rings 28. Thus, the supporting members 36 can be easily moved horizontally along the long grooves 47.

Springs 38 are wound around the pins 37 which are fixed in the lower portions of the rocking levers 33. One end of the spring 38 is held by the lug 40 formed at the bottom end of the rocking lever 33 and the other end of the spring 38 is supported against pin 35. Thus, the pin 35 and the rearward end of the supporting member 36 are urged upward.

The cartridge frame 41 is U-shaped and is made of a flexible synthetic resin. The leg portions 46 on both sides of frame 41 are provided with supporting holes 43 for snap-in receiving and supporting of the ink roller 54. The facing hook shaped or C-shaped (in cross-section) grooves 44 at the top and bottom are defined on the exterior sides of both leg portions 46. The interconnecting web 49 between the both legs 46 is also provided with similar hook shaped grooves 45.

When the ink roller 54 is attached to the cartridge frame 41, the leg portions 46 are separated, and the shaft 57 of the ink roller 54 is inserted into the supporting in the cartridge frame 41. The cartridge frame 41 is, in turn, attached to the supporting members 36 by bringing the grooves 44 on leg portions 46 into sliding engagement with the projecting lugs 18 at the top and bottom of the supporting members 36.

The rearward side of the holder 42 is provided with upwardly and downwardly projecting supporting lugs 50 which are slidably fitted into the grooves 45 on the forward side of the cartridge frame 41. Further, holes 51 are formed on the side walls of the holder 42 to receive respective pins 52. In order to prevent the pins 52 from slipping into the holes 51, the pins 52 are provided with snap rings 53 that are received in grooves around the pins. The pins 52 are urged to stick out of the holes 51 by springs 55 which are inside holes 51 and push on pins 52. The projecting ends of the pins 52 are received in the supporting holes 56 of pins 30, which pins are fitted to the front ends of the supporting members 36.

When the ink supply in the ink impregnated ink roller 54 is exhausted, the ink roller assembly 48 can be slipped off the supporting members 36. The cartridge frame 41 with the ink roller 54 is then separated from the holder 42. The used ink roller 54 is replaced with a new one. The cartridge frame 41 supplied with a new ink roller 54 is attached to the frame holder 42 redefining the ink roller assembly 48. The ink roller assembly 48 is then mounted to the supporting members 36.

The supporting members 36, which carry the ink roller assembly 48, are normally urged upward along the long grooves 47 by springs 38. The ink roller 54 is also urged toward the type face 20 with constant pressure by the force of the springs 38.

LABEL STRIP ADVANCING MECHANISM

Figure 4:
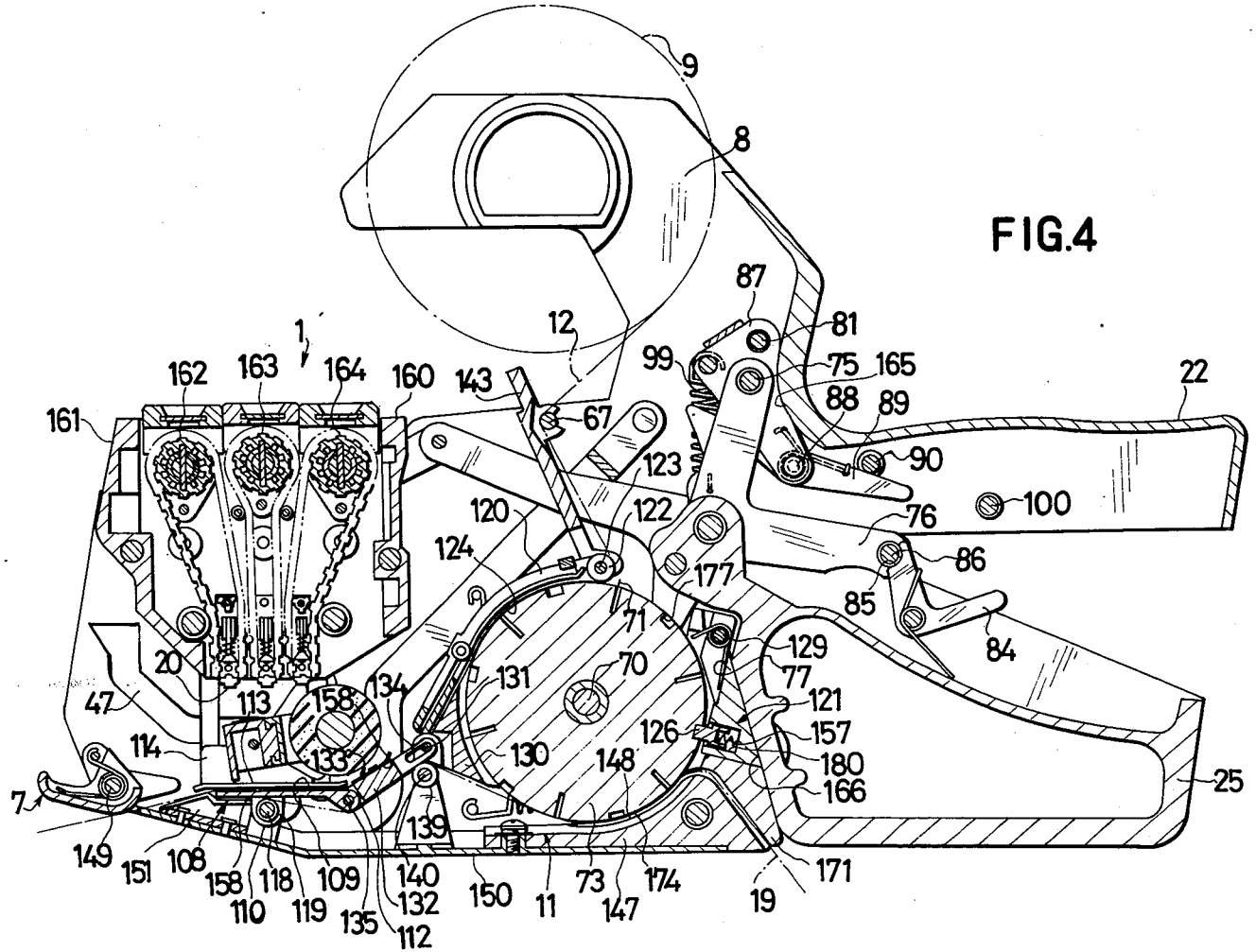
FIG. 4 is a vertical cross-sectional view of the labeler taken on its center plane.
Figure 16:
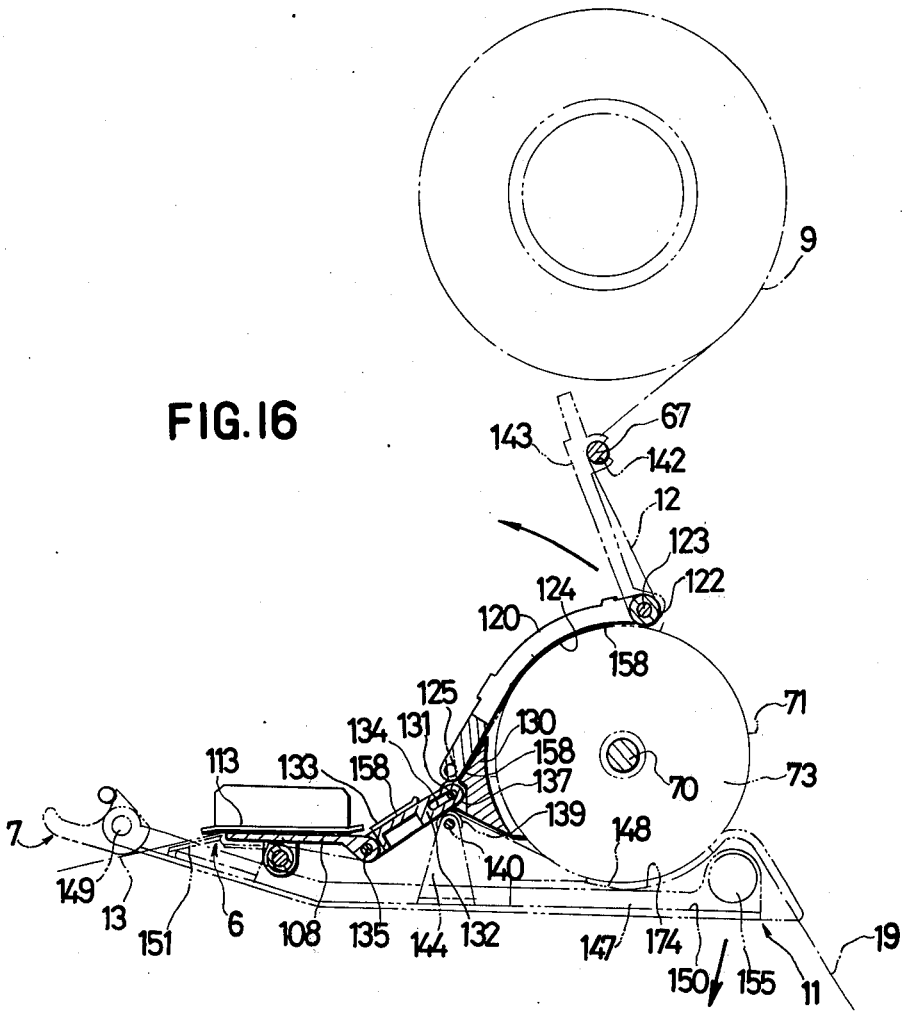
FIG. 16 is a vertical, cross-sectional fragmentary view showing the passages for the label strip and the carrier strip through the labeler.

A typical label strip advancing mechanism is illustrated in copending U.S. Application Ser. No. 686,562, filed May 14, 1976. A label holder 8 supports the rolled label strip 9. As shown in FIGS. 3, 4 and 16, the advancing mechanism comprises a feed roller 73, hooks 74 on both sides of the roller 73, a guide member 120, a stopper 121 (FIG. 4), a guide block 130, a guide plate 132, a bottom cover 11 for the labeler, a label strip passage 158 and a carrier strip passage 174.

The feed roller 73 has a plurality of spaced-apart teeth 71 on its peripheral surface. Roller 73 is rotatably supported on the main shaft 70, which is attached to the machine frame 21. On both sides of said feed roller 73, there are equally angularly and radially spaced indexing pins 72. As disclosed above, the hooks 74 are attached to the hook pins 68 of the driving levers 69. Levers 69 are in turn, connected to the hand lever 25 and are urged counterclockwise by springs 80. Thus, the hooks 74 are biased to engage the then adjacent indexing pins 72.

As shown in FIG. 16, the front end of the upper guide member 120 is pivotally supported by a support pin 125 that is attached to the machine frame 21. The rear end of the guide member 120 is provided with a pin 123 which pivotally supports a label strip passage opening lever 143 and a guide roller 122. The guide member 120 is bent down so as to conform its curved lower surface 124 to the upper surface of the feed roller 73. The lower half of the guide member 120 extends tangentially to the support pin 125. The upper end of the opening lever 143 is provided with a C-shaped flexible snap catch 142, which is detachably snap fitted to a shaft 67 that is fixed to the machine frame 21.

Figure 9:
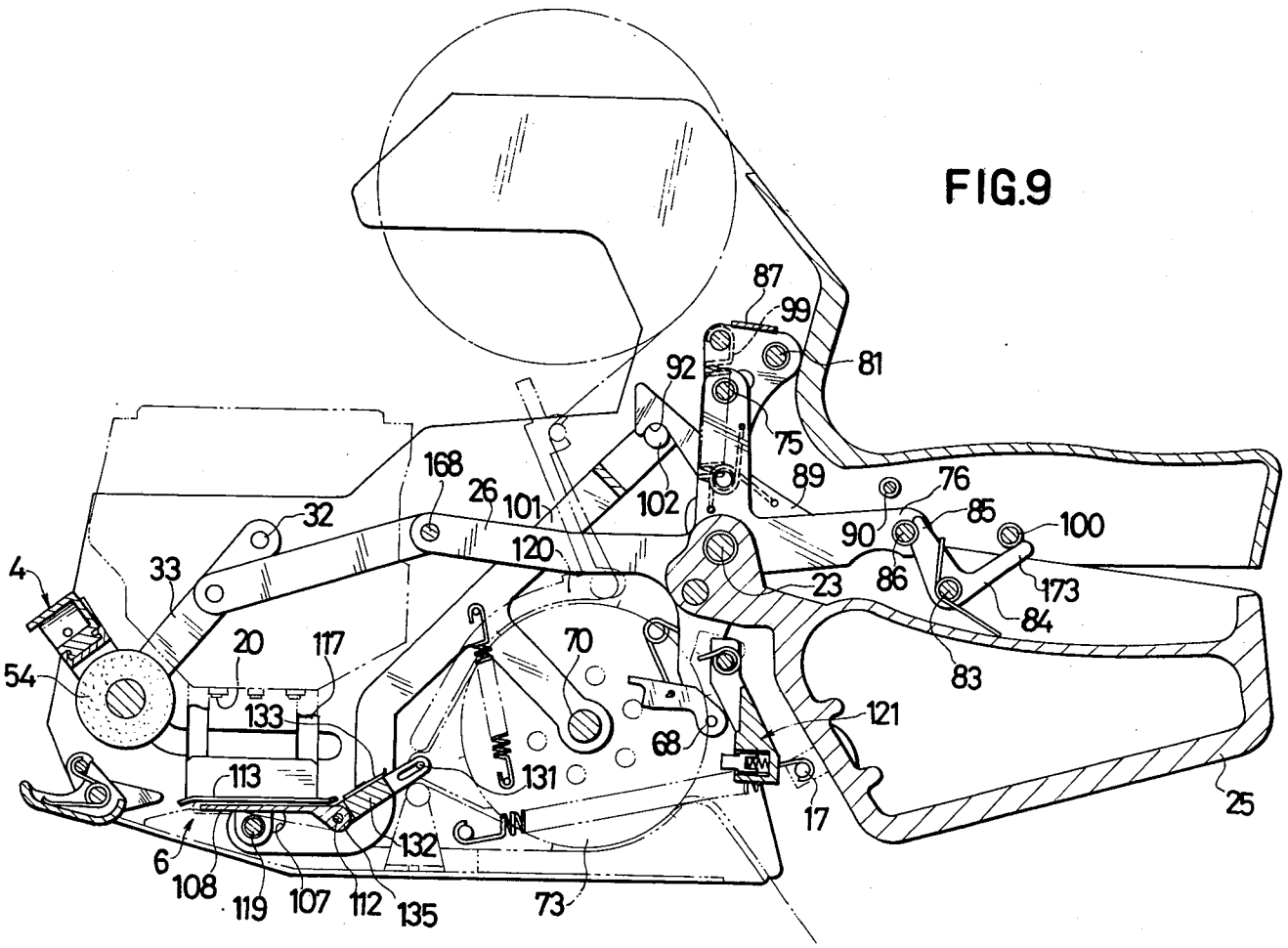
Figure 15:
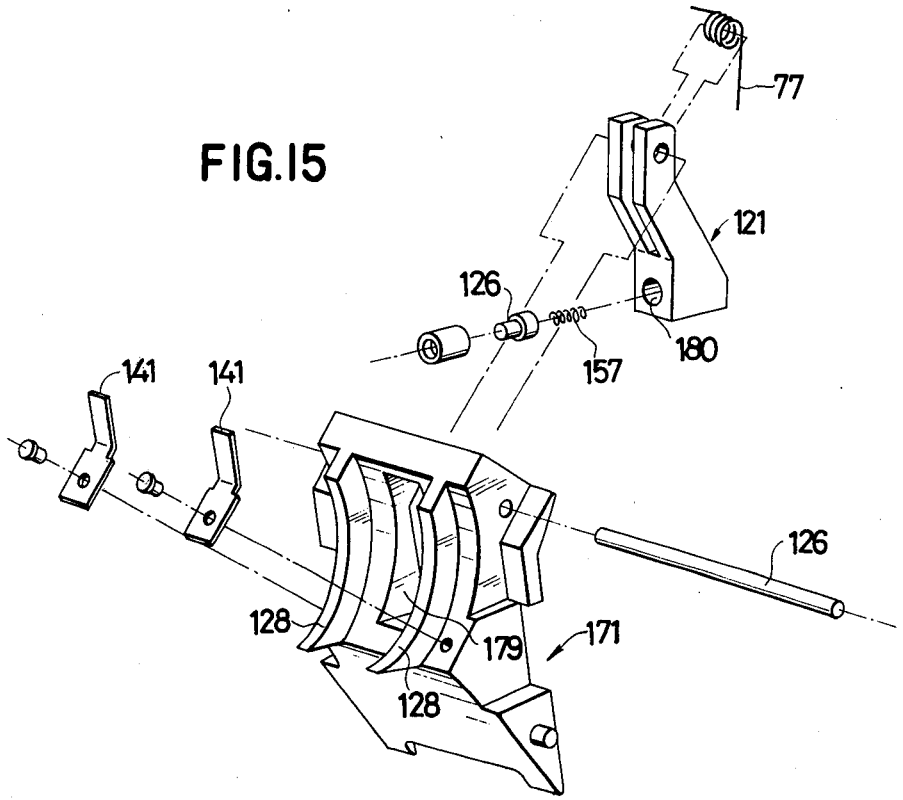
FIG. 15 is an exploded perspective view showing the stopper for preventing the advancing roller from turning too much and the roll-up preventing member.

As shown in FIGS. 4, 9 and 15, the stopper 121 for halting advancing of the label strip is fitted into a rectangular opening 179 of a roll-up preventing member 171 fixed between the side plates 14, 15. The stopper is pivotally supported on a shaft 129 and is urged counterclockwise by a torsion spring 77. Spring 77 is wound on shaft 129 and one end presses on stopper 121 and the other end engages an abutment on the machine frame. The rear side of the stopper engages the forward side 166 of the hand lever 25. In the usual state, the stopper 121 is pushed toward the peripheral surface of the feed roller 73 by the forward side 166 of the hand lever 25. The hole 180 formed in the lower portion of the stopper 121 at its forward side holds a stopper piece 126 therein. This stopper piece 126 is urged out of hole 180 by a spring 157. Thus, as shown in FIG. 4, the stopper piece 126 engages in one of the recesses 177 formed around the outer surface of the feed roller 73 at regular intervals. By this means, inertial rotation of the feed roller 73 can be prevented. On both sides of the stopper 121, a pair of roll-up preventing pieces 128 are formed on member 171 for engaging the surface of and preventing the carrier strip 19 from being over-rolled around the feed roller 73. Further, a pair of check springs 141 which prevent reversal of rotation direction of the feed roller 73 are fixed outside of both of the roll up preventing pieces 128. Springs 141 engage with recesses 178 spaced at regular intervals around the feed roller 73, as shown in FIG. 3.

As shown in FIG. 16, in front of the feed roller 73 and below the guide member 120, a guide block 130 is attached to the machine frame 21 defining the label passage 158 between member 120 and block 130. A pin 131 is attached between the wall pieces 137 at the front portion of the guide block 130. The pin 131 is inserted into the elongated slots 134 formed in the rear portion of the guide plate 132. The front end of the guide plate 132 is pivotally connected to the holes 112 (FIG. 6) of the platen assembly 108 by a pin 135. On the both sides of said guide plate 132, cover pieces 133 are attached to define the label passage 158. The clearance of passage 158 is slightly larger than the thickness of the label strip 12. The label strip 12 is thus held within the passage 158. The label strip 12 passes through the guide plate 132 and advances to the platen assembly 108. In the peeling device 6 at the front end of the platen assembly 108, the label strip 12 is divided into labels 13 and a carrier strip 19. Only the carrier strip 19 is led under the feed roller 73 past the bottom cover 11.

The bottom cover 11 comprises a channel shaped bottom plate 150 which is pivotally supported at its front end by a pin 149 attached to the front of the machine frame 21. At the rear side of the pin 149, the bottom plate 150 is provided with a label support 151 near pin 149, a stand 144 having a pin 140 that supports a carrier strip roller 139, and at a further rear portion, a carrier strip guide 147 having a curved surface 148 that corresponds to the outer surface of the feed roller 73. When the latching buttons 155 are depressed, the engagement between the bottom cover 11 and the machine frame 21 is released and the cover 11 can be swung open around the pivot pin 149 as shown in broken lines in FIG. 3. The carrier strip 19 is passed through the passage 174 defined between the above-mentioned curved surface 148 of the carrier strip guide 147 and the outer surface of the feed roller 73.

APPLICATOR

The applicator 7 to apply the labels 13 that have been peeled from the carrier strip 19 to the surfaces of articles, is pivotally supported by the pivot pin 149 which also pivotally supports the bottom cover 11. Biasing means bias the applicator 7 to press the labels onto the articles.

PEELING DEVICE

The peeling device 6 comprises the narrow clearance space formed between the upper side of the middle portion of the label support 151, the lower sides of the front ends of label guide plates 113 and the front void space in front of the platen 109; the label passage 158 on the platen 109; and the carrier strip passage 174 formed between the lower surface of the platen assembly 108 and the upper surface of the label support 151.

OPERATION

In the following, the functioning of the hand labeler with the first embodiment of constant printing pressure mechanism is explained.

The label strip is loaded in the hand labeler. As shown in FIG. 3 by broken lines, the C-shaped catch 142 of the opening lever 143 is snapped off the shaft 67. The opening lever 143 is pulled up and counterclockwise so as to swing open the guide member 120 around the support pin 125. This eases initial threading of the label strip 12. Also, the locking buttons 155 are depressed to open the bottom cover 11 on the pivot shaft 149.

Figure 17:
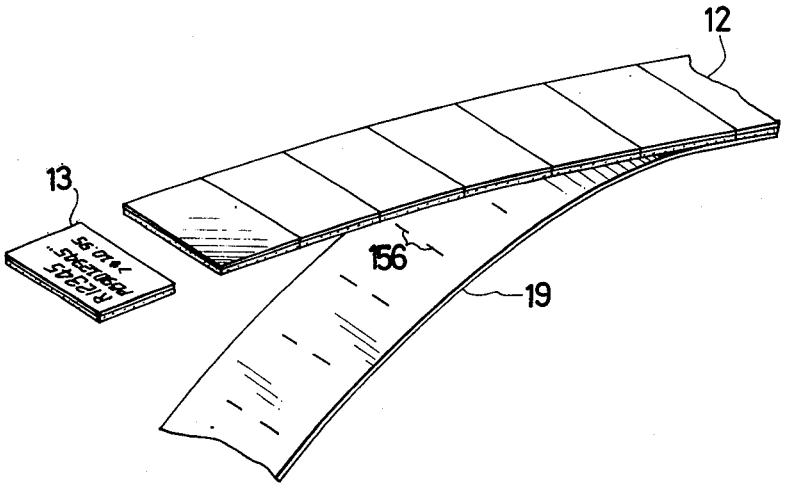
FIG. 17 is a perspective view of the label strip.

A rolled label strip 9 is mounted to the label holder 8 and the label strip 12 is unrolled. The slits 156 in the label strip 12 (FIG. 17) are engaged with the teeth 71 on the feed roller 73. Then the opening lever 143 is lowered so as to press the label strip 12 against the upper outer surface of the feed roller 73 with the curved surface 124 of the guide member 120. The guide member 120 is fastened at the original position by fixing the catch 142 to the shaft 67, as shown with solid lines in FIG. 3.

The grip 22 and hand lever 25 are squeezed repeatedly. As shown in FIG. 16, the label strip 12 is advanced through the passage 158 between the outer surface of the feed roller 73 and the curved surface 124 of the guide member 120, then between the guide member 120 and the guide block 130, further on the guide plate 132, and between the platen 109 and the label guide plates 113. The free end of the label strip 12 is advanced through the peeling device 6. Then the carrier strip 19 of the label strip 12 is doubled over within the clearance space in the peeling device 6 and it is carried under the feed roller 73 until the slits 156 in the carrier strip 19 are properly caught by the teeth 71 of the feed roller. The bottom cover 11 is then returned to and latched in its closed position. Loading of the label strip 12 is complete, as shown in solid lines in FIG. 3.

When the hand lever 25 is squeezed, the rocking levers 33 are pivoted clockwise by the counterclockwise pivoting of the yokes 26 and the clockwise and downward motion of the driving levers 29. The rings 28 projecting from the ink roller supporting members 36 are guided along the generally horizontal grooves 47 formed on the machine frame 21 and the ink roller assembly 48 is moved forward by pivoting of the rocking levers 33.

During the forward movement of the ink roller assembly 48, the ink roller 54 rolls across the type face 20 and inks it.

As shown in FIGS. 13 and 14, since the rings 27 of the inking roller supporting member 36 slide within the slots 31 of the rocking levers 33 under the influence of the springs 38, the ink roller 54 is pushed and squeezed against the type face 20 with a proper pressure.

Figure 10:
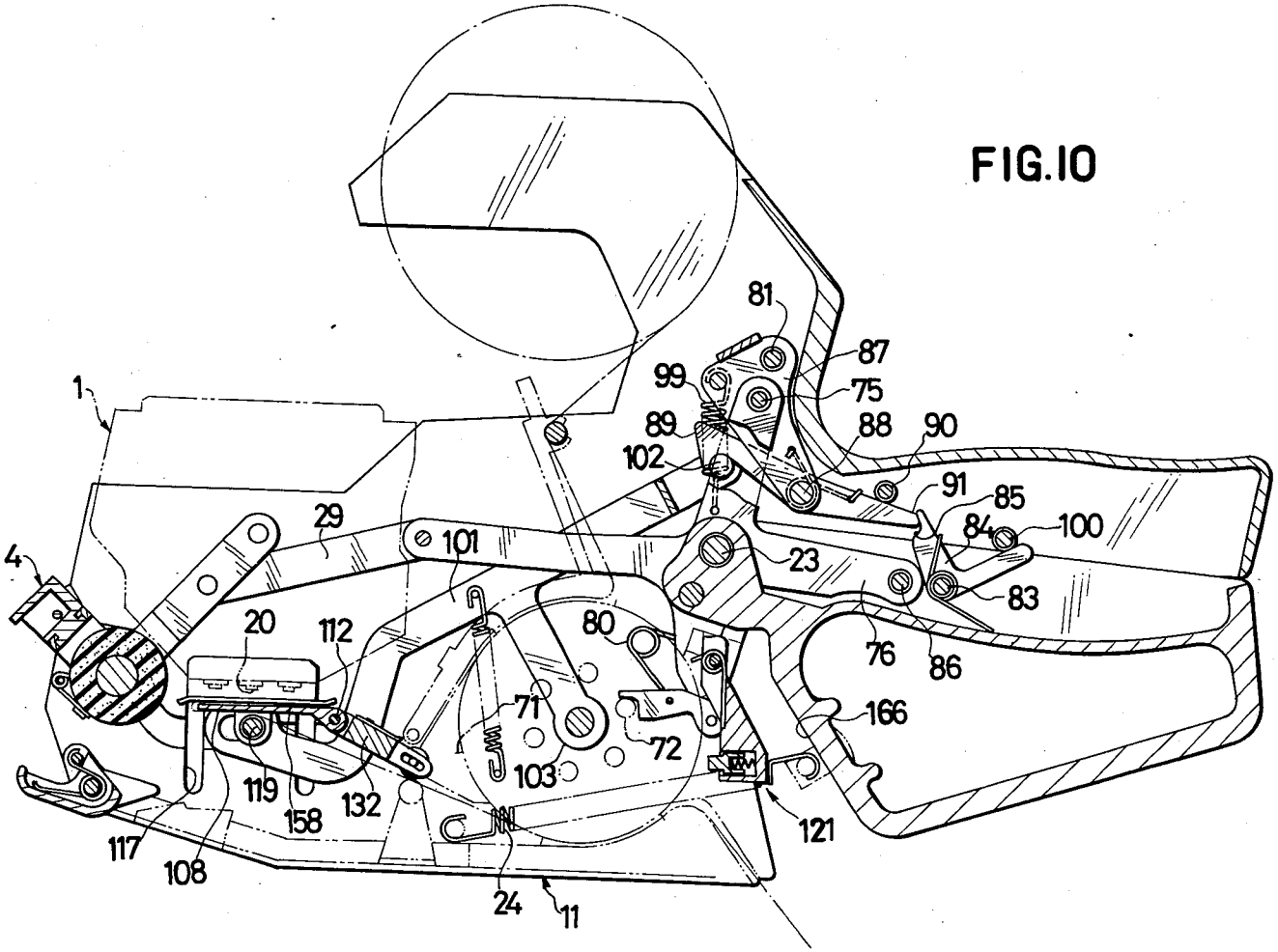
Figure 11:
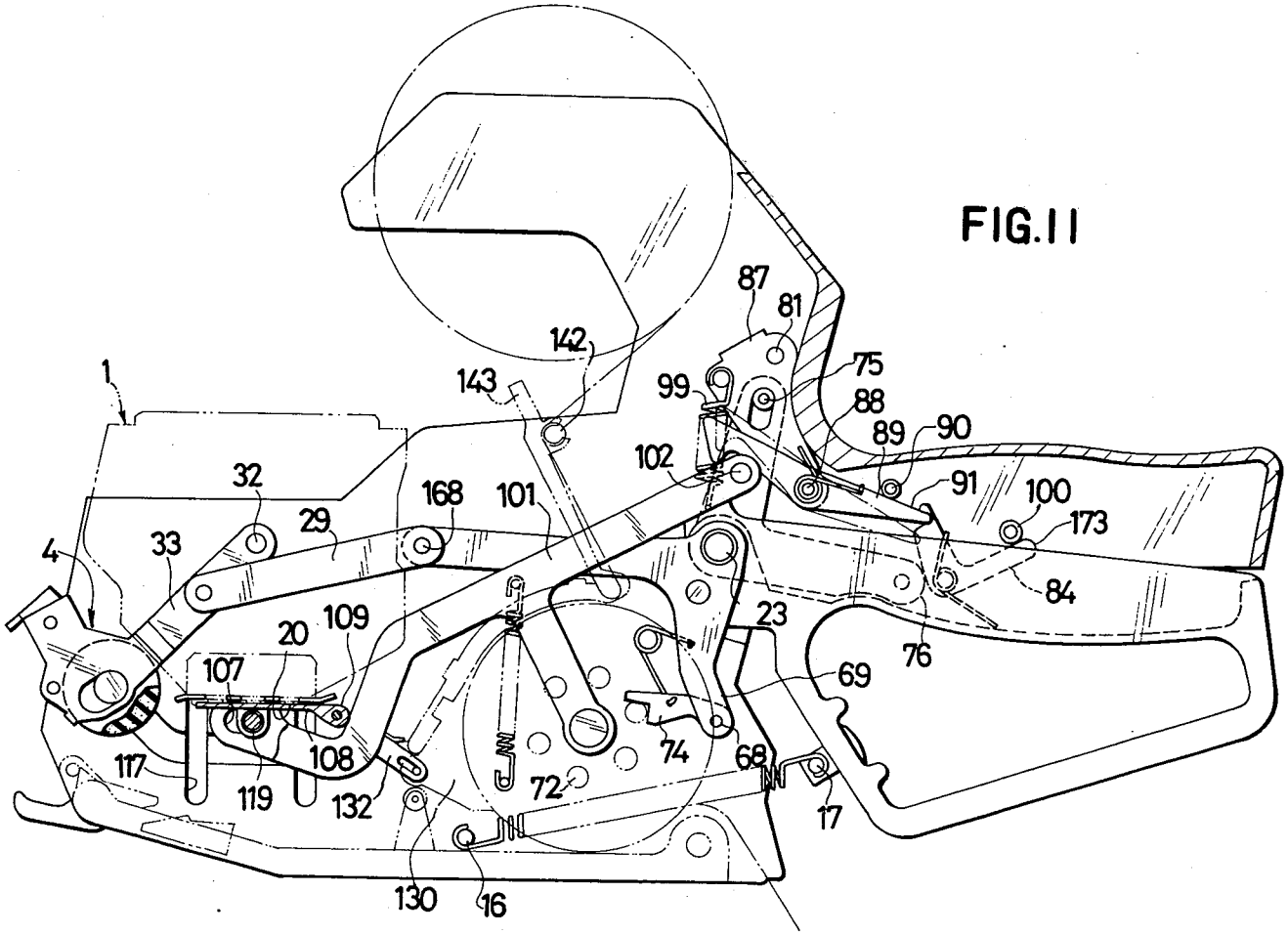
Figure 12:
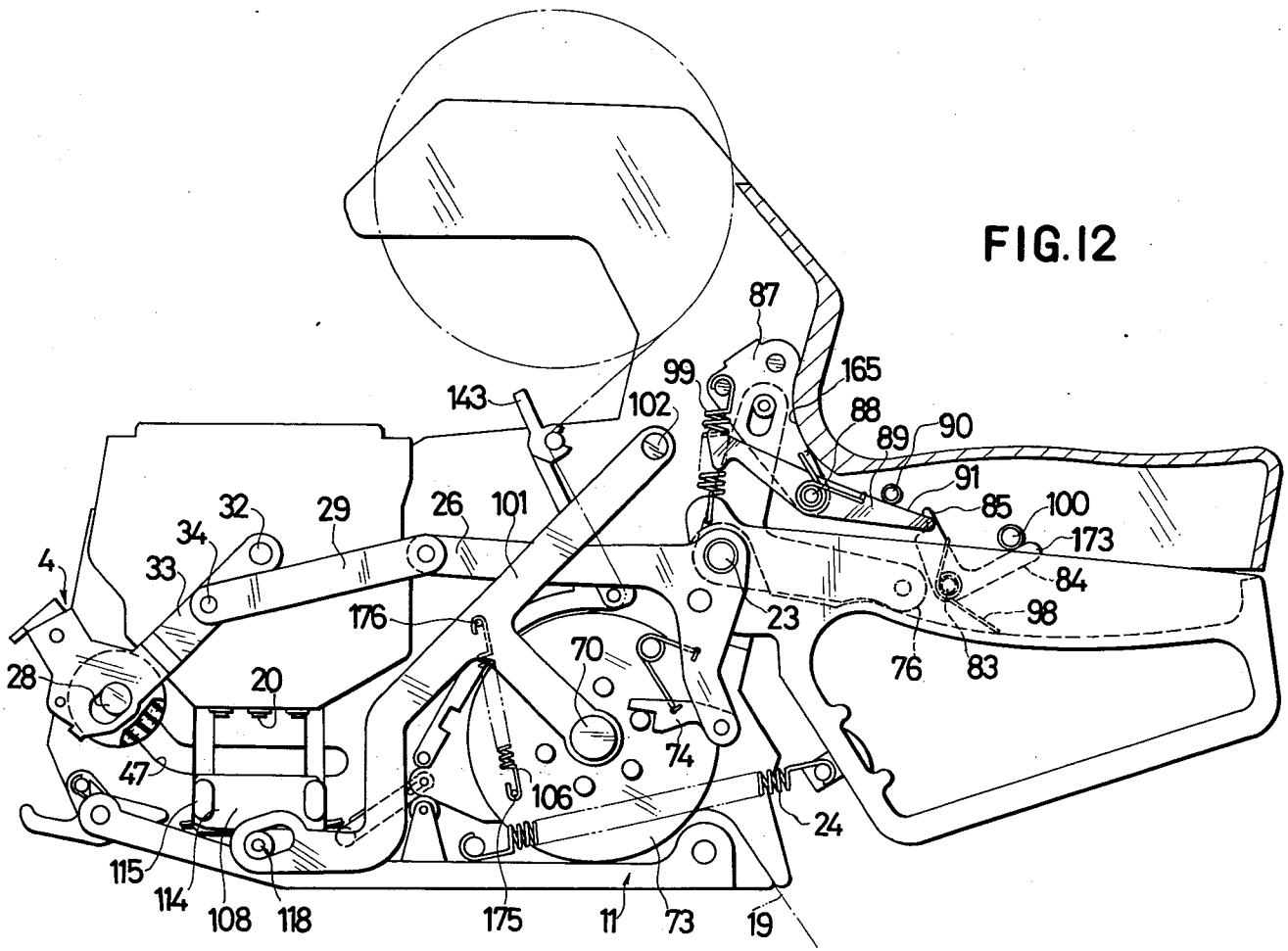

Simultaneously with the inking, the constant pressure mechanism 3 is actuated, as explained with reference, especially to FIGS. 4, 9, 10, 11 and 12. In FIG. 4, the hand lever 25 is released; in FIG. 9, it is partly squeezed; in FIG. 10, the hand lever 25 is almost completely squeezed; and FIG. 11 shows the moment of printing where the label 13 is pressed against the type face 20 by the platen assembly 108. FIG. 12 shows the working of the constant pressure mechanism following a certain elapsed time after the squeezing of the hand lever 25.

When the hand lever 25 is squeezed from the state shown in FIG. 4, the recess 85 of the lifting member 84 pushes up the supporting rod 86. This pivots the first lifting pawl levers 76 counterclockwise about the pivot shaft 23 and the parts move to the state shown in FIG. 9. The movement of the first lifting pawl levers 76 pivots the second lifting pawl levers 87 clockwise about the shaft 81. The tensioned lifting springs 99 are stretched and store potential energy. Pivoting of levers 87 also moves shaft 88 forwardly and the lifting pawls 89 are moved forward while their rearward inclined surfaces 91 remain in engagement with the stop pin 90, as shown in FIGS. 3 and 4. When the front inclined surfaces 93 of the lifting pawls 89 contact the hook pins 102, they are biased upward by the hook pins 102 and the lifting pawls 89 rotate clockwise around the shaft 88. This disengages rear inclined surfaces 91 from the second stop pin 90. At the same time, the hooks 92 are caught by the hook pins 102 since the pawls 89 are urged to pivot counterclockwise by the springs 96. This is shown in FIG. 9. In this step, when the hand lever 25 is still further squeezed, the rear end 173 of the lifting member 84 contacts the stop pin 100 and the lifting member 84 is rotated clockwise around the shaft 83. This releases the engagement between the pin 86 and the recess 85, as shown in FIG. 10. Upon this disengagement, the second lifting pawl levers 87 are pivoted counterclockwise around the shaft 81 by the force of lifting springs 99 and the lifting pawls 89 are returned rearwardly. At the same time, the first lifting pawl levers 76 are turned clockwise around the shaft 23 because of their engagement with the slot 82 in pawl lever 87.

The rearward movement of the lifting pawls 89 quickly turns the platen lifting levers 101 clockwise around the main shaft 70, as shown in FIG. 10. This raises the platen assembly 108. As shown in FIG. 11, the platen assembly 108 knocks against the type face 20 under the force exerted by the lifting springs 99 on the levers 87 and by the pawls 89 and the inertia of platen 108 which is moved quite rapidly by springs 99. The label 13 then on the platen 109 is printed by this momentary stroke of the platen.

As the rear inclined surfaces 91 of the lifting pawls 89 contact the second stop pin 90 due to the rearward movement of the lifting pawls 89, the hooks 92 are raised, as shown in FIG. 12. This releases the lifting pawls 89 from the hook pins 102. The lifting levers 101 are returned counterclockwise about the main shaft 70 by the force of the springs 106. Thus the platen assembly 108 is returned to its normal position.

The up and down movement of the platen assembly 108 is quite rapid and independent of hand pressure, so that the label strip 12 on the platen 109 can be knocked against the type face 20 with constant pressure and for a constant time period. In addition, the vertical shifting of the platen assembly 108 is finished before the hand lever 25 is completely squeezed.

The ink roller assembly 48 has passed through the platen assembly 108 but is then still continuing its advancing motion.

As shown in FIG. 3, when the hand lever 25 is then released, the ink roller assembly 48 returns rearwardly. The lifting member 84 returns to the position at which the recess 85 of the lifting member 84 is engaged with the supporting rod 86. The driving levers 69 are turning clockwise with the yokes 26. Thus, the hooks 74 on both sides of wheel 73 engage the indexing pins 72 on the wheel 73 and move the pins forward. The feed roller 73 is rotated counterclockwise through a predetermined angle and the label strip 12 and the carrier strip 19 are simultaneously fed a predetermined distance. When the carrier strip 19 is sharply bent backward within the narrow clearance in the peeling device 6 so as to define a slack loop, the label 13 on the label strip 12 is peeled off and advances straight. The front edge of the peeled label 13 is delivered under the applicator 7 and each label 13 is applied to the surface of an article by the applicator 7.

Figure 18A:
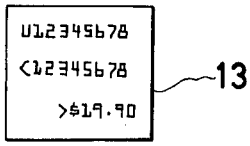
FIGS. 18*a* and 18*b* show examples of labels printed with OCR letters and bar codes, respectively.
Figure 18B:
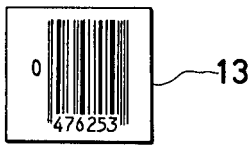

In the first embodiment, the platen assembly 108 is knocked against the type face 20 only by the action of the lifting springs 99. No matter if the hand lever 25 is squeezed strongly, or weakly, or for a long time or momentarily, clear and precise printing of labels as shown in FIG. 18. can be always performed.

Figure 19:
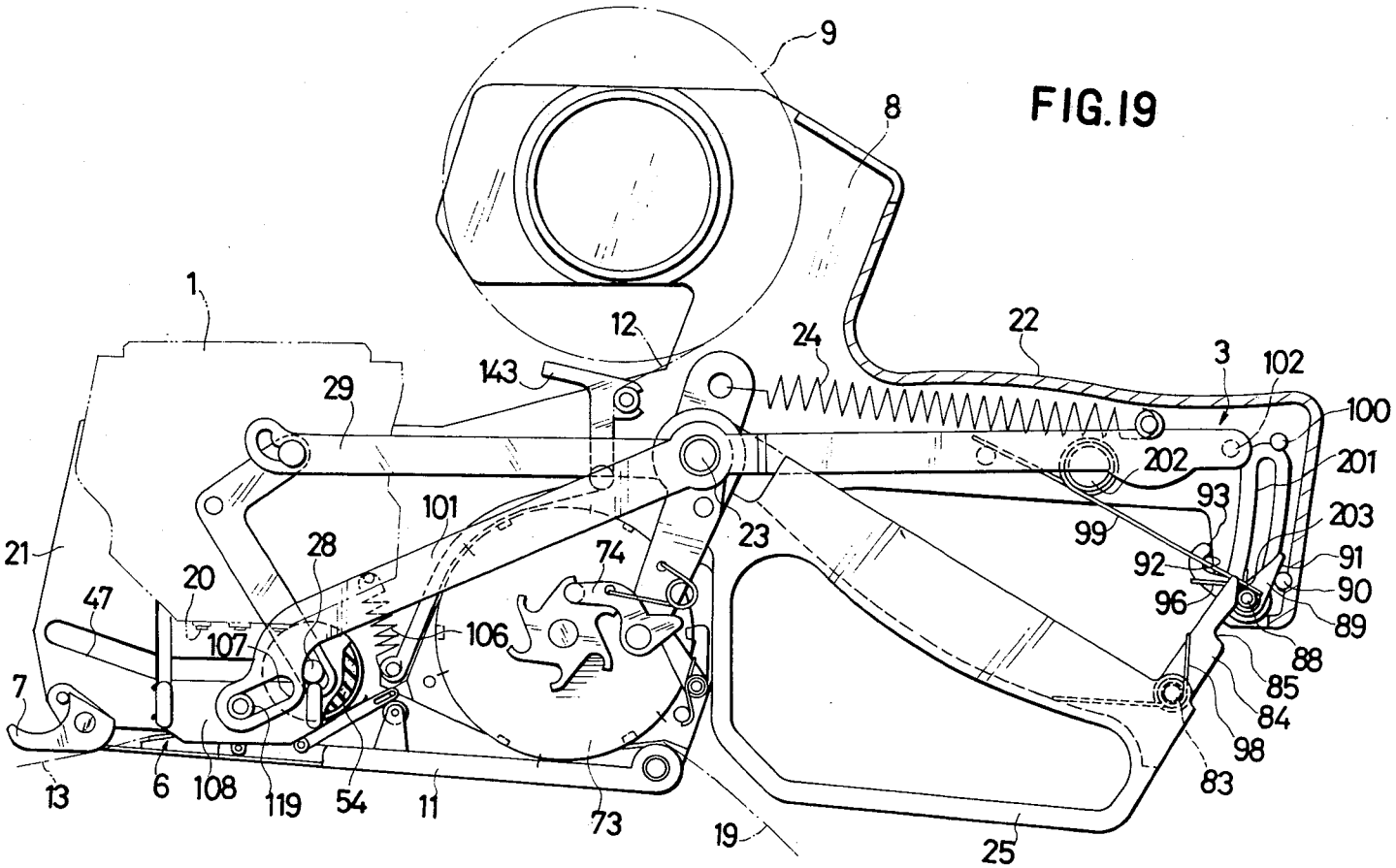
FIG. 19 is a side elevational view, with the side plate of the labeler removed, of a labeler containing the second embodiment of the constant pressure mechanism.
Figure 20:
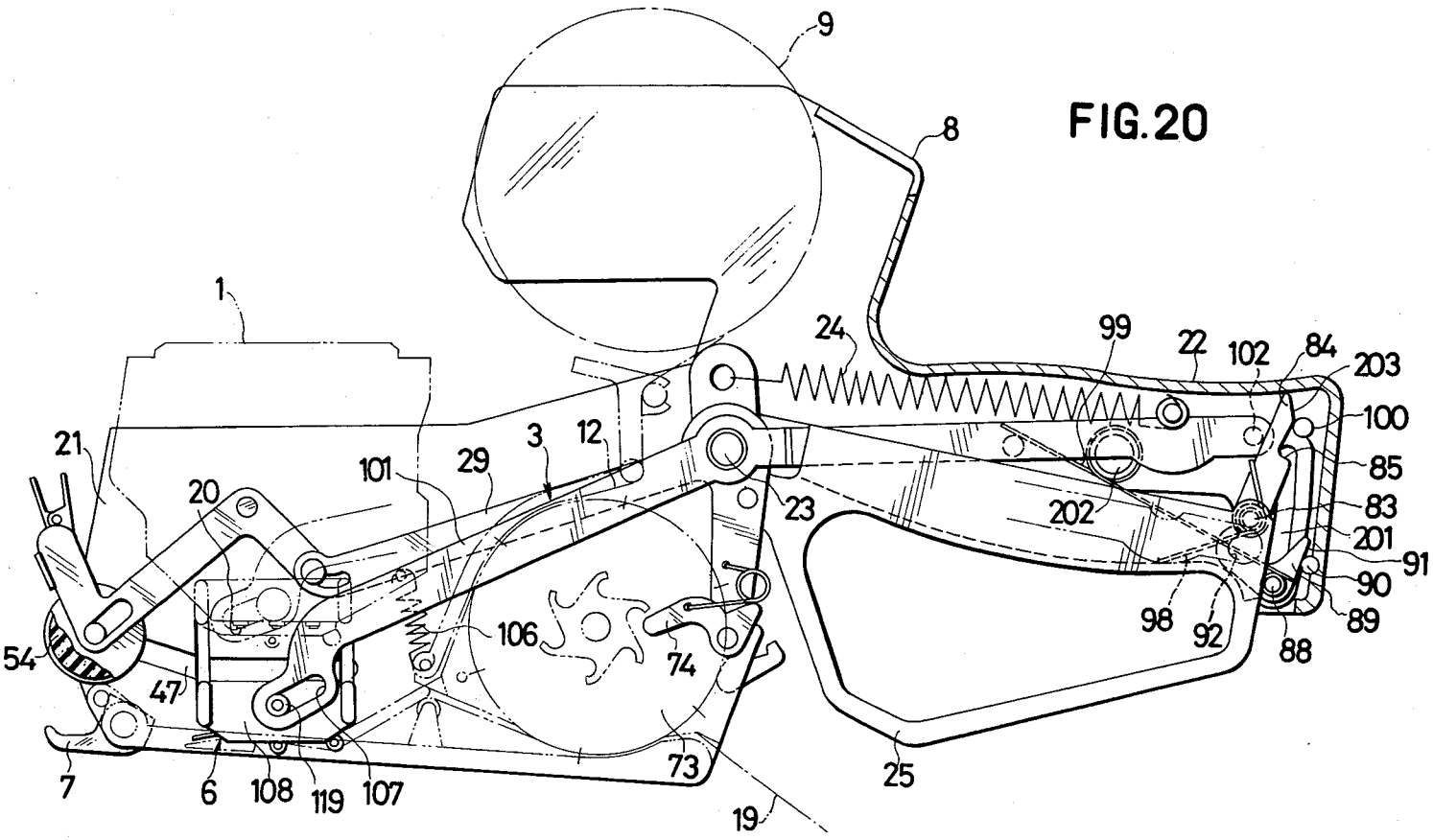
FIG. 20 is the same view as FIG. 19, wherein the hand lever has been squeezed.

The second embodiment of constant pressure mechanism according to the present invention is now explained with reference to FIGS. 19 and 20. Here, the platen lifting levers 101 are attached to the shaft 23 which pivotally supports the hand lever 25, and the hook pin 102 is positioned inside the grip 22. A lifting pawl 89 is guided to shift within the vertically elongated guide groove 201 formed on the grip. Pawl 89 is rocked directly by the lifting member 84. The platen lifting levers 101 are pivotally secured to the shaft 23 at the middle portion of these levers. The front side end portions of the levers 101 extend under the printing device 1. These front end portions of the levers 101 have slots 107 which receive the rings 119 that project from both sides of the platen assembly 108. The levers 101 are normally urged to pivot counterclockwise by the springs 106.

The lifting pawl 89 is pivotally supported on a lifting pawl shaft 88 that is engaged with the guide groove 201. The pawl 89 is urged clockwise by a torsion spring 96 wound on the shaft 88. The lifting pawl 89 is further urged down by another torsion spring supported on the fixed projection 202 formed on the inside of grip 22 and in engagement at one end with the pawl 89 and at the other end with an abutment in grip 22. When the lifting pawl 89 is at the bottom position in groove 201, its rear (upper) inclined surface 91 is held by the second stop pin 90 formed on the grip 22. At the upper position of pawl 89, its hook 92 at the other side of pivot shaft 88 engages the hook pin 102 formed on the platen lifting lever 101.

Before the hook 92 is caught by the hook pin 102, the front inclined surface 93 of the hook contacts the hook pin 102 and the lifting pawl 89 pivots slightly counterclockwise against the force of spring 96, whereby the hook 92 snap engages the hook pin 102. To disengage the pawl from hook pin 102, the rear inclined surface 91 of pawl 89 is brought into contact with the second stop pin 90 and the lifting pawl 89 is turned counterclockwise against the force of the spring 96.

The lifting member 84 which pushes up the lifting pawl 89 is attached to the supporting shaft 83 at the rear upper portion of the hand lever 25. The lifting member 84 has an inclined surface 203 at the upper tip end and a supporting recess 85 is formed under the inclined surface 203. The lifting member 84 is urged to pivot clockwise by a torsion spring 98 wound about the shaft 83 and having one end in engagement with member 84 and the other end in engagement with an abutment in lever 25. During descent of hand lever 25 and lifting member 84, the inclined surface 203 contacts the lifting pawl shaft 88. During their ascent, the surface 203 makes contact with the first stop pin 100 formed on the grip 22.

When the grip 22 and the hand lever 25 are squeezed, the type face 20 of the printing device 1 is first inked by the ink roller 54 which is guided by the long grooves 47 formed on the machine frame 21.

The constant pressure mechanism 3 simultaneously operates. As the hand lever 25 is squeezed, the lifting member 84 is raised and the lifting pawl shaft 88 is caught by the recess 85. The shaft 88 and pawl 89 are raised along the guide grooves 201 against the action of the tensioned springs 99. The front inclined surface 93 of lifting member 84 contacts the hook pin 102 and the hook 92 hooks the hook pin 102. With this upward movement, the springs 99 are tensioned.

Simultaneously with the hooking of the hook pin 102 by the hook 92 of the lifting pawl 89, the inclined surface 203 of the lifting member 84 is pushed by the first stop pin 100 and the member 84 is pivoted counterclockwise around the shaft 83. This disengages the recess 85 from the lifting pawl shaft 88. The lifting pawl 89 and its shaft 88 are biased downwardly by the force of the lifting springs 99. Because the hook 92 of the lifting pawl 89 is still in engagement with the hook pin 102, the hook pin 102 is also drawn downward causing abrupt clockwise motion of the platen lifting lever 101 about pivot shaft 23. The platen assembly 108 is raised and caused by knock against the type face 20 of the printing device 1.

Immediately prior to the contact of platen assembly 108 with the type face 20, the rear inclined surface 91 of the lifting pawl 89 contacts the second stop pin 90 and the pawl 89 is turned counterclockwise. This disengages the hook 92 from the hook pin 102.

But because the platen and the platen lifting levers 101 have their inertia, they continue their original motion and knock the platen assembly 108 against the type face 20. The label 13 of label strip 12 then on the platen assembly 108 is printed clearly. The platen assembly 108 knocks against the type face 20 with a constant pressure determined only by the lifting spring 99.

Following this printing action, because the hook 92 is already disengaged from the hook pin 102, the platen lifting levers 101 are returned counterclockwise by the reaction to the printing stroke and the normal tension of the springs 106 pulling the levers 101 counterclockwise.

When the hand lever 25 is then released, the ink roller 54 is returned under the printing device 1 along the long groove 47 by the force of the tension spring 24. The lifting member 84 is lowered until its inclined surface 203 contacts the lifting pawl shaft 88. The feed roller 73 is moved counterclockwise by the hooks 74. Thus, all elements are returned to their original positions as shown in FIG. 19.

Figure 21:
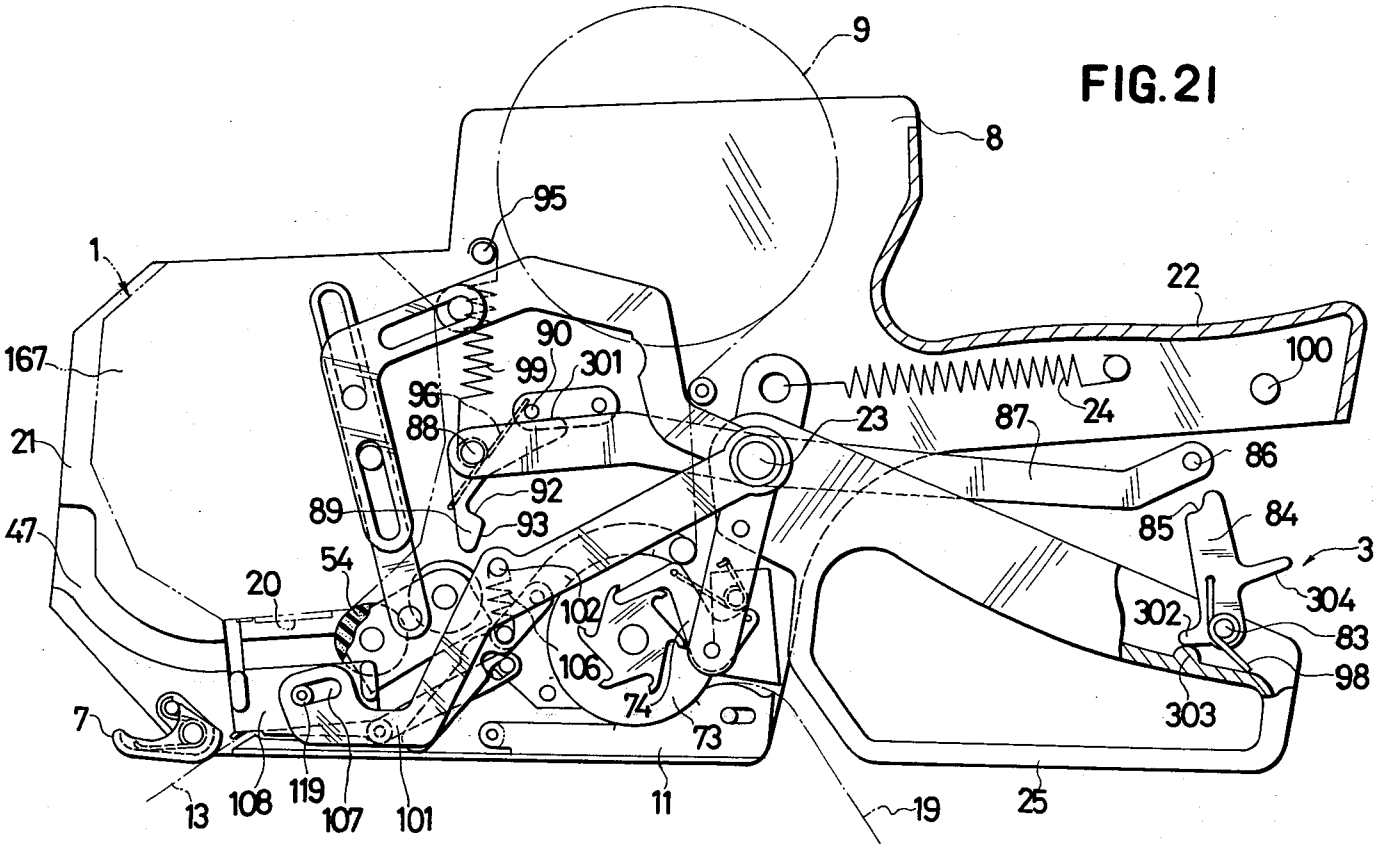
FIG. 21 is the same type of view as FIG. 19 with the labeler containing the third embodiment of the constant pressure mechanism.
Figure 22:
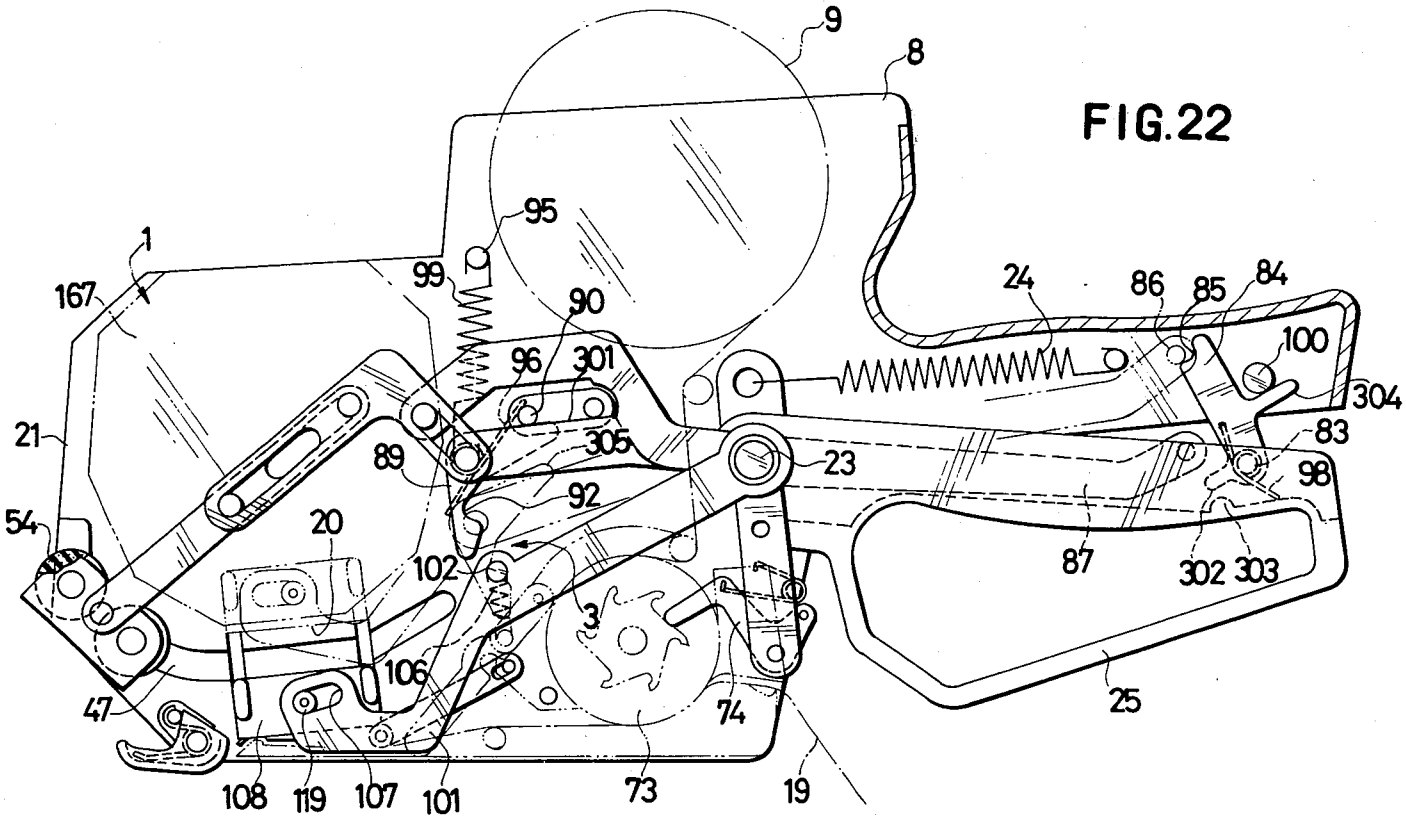
FIG. 22 is the same view as FIG. 21, wherein the hand lever has been squeezed.

The third embodiment of constant pressure mechanism 3 of the present invention is illustrated in FIGS. 21 and 22. Here, the platen lifting levers 101 are also pivotally connected to the shaft 23 on which the hand lever 25 is pivotally supported. Shaft 23 is attached to the machine frame 21. The rings 119 projecting from both sides of the platen assembly 108 are loosely fitted into the slots 107 formed at the front end portions of the platen lifting levers 101 which extend under the printing device. The hook pins 102 are attached to the levers 101 between the slots 107 and the shaft 23. The levers 101 are urged counterclockwise by the springs 106.

The lifting pawl 89 is pivotally attached by a lifting pawl shaft 88 to the front ends of lifting pawl levers 87 secured at their middle portions to the shaft 23. The supporting rod 86 is integrally formed on the rear end of the lifting pawl levers 87, extends under the grip 22 and can be pushed up by the lifting member 84. Thus, the lifting pawls 89 are rocked together with their shaft 88 on levers 87. Further, the lifting pawls 89 are urged counterclockwise by the torsion spring 96 wound upon the shaft 88. When the lifting pawls 89 are in the raised position, the upper surface 301 of the lifting pawl levers 87 contact the stop pin 90 affixed to the machine frame 21, thereby stopping the movement of the levers 87. When the lifting pawls 89 are lowered, their front inclined surfaces 93 move into contact with the hook pins 102 and the pawls 89 are turned slightly clockwise. This enables the hooks 92 to snap engage the hook pins 102.

The lifting pawl levers 87 are urged clockwise by the springs 99, which are stretched between a spring pin 95 and the above mentioned lifting pawl shaft 88. The levers 87 are stopped by the stop pin 90 contacting the upper surface 301 of the levers.

The lifting member 84 has a recess 85 at its top end. Member 84 is pivotally attached to the hand lever 25 by a shaft 83, and it is urged counterclockwise by the spring 98 wrapped around said shaft 83. The counterclockwise rotation of the member 84 is stopped by the engagement between the projection 302 on the member 84 and another projection 303 formed on the hand lever 25. When the hand lever 25 is squeezed, the recess 85 contacts the supporting rod 86 and the lifting pawl levers 87 are pivoted counterclockwise. When the depressing member 304 is raised into engagement with the stop pin 100 formed on the grip 22, the lifting member 84 is pivoted clockwise and the recess 85 disengages from the supporting rod 86.

When the hand lever 25 is squeezed, ink is applied to the type face 20 of the printing device 1 by the ink roller 54. Simultaneously with this inking, the lifting member 84 rises and its recess 85 contacts the supporting rod 86. The rod 86 is raised against the force of the lifting springs 99 and the lifting levers 87 are turned counterclockwise causing the descent of the lifting pawls 89. As the lifting pawls 89 move down, they are biased counterclockwise by the spring 96. The inclined surface 93 of the pawls 89 are brought into contact with the hook pin 102. Thus, the pawls 89 are turned clockwise slightly and their hooks 92 engage the hook pins 102.

The downward movement of the lifting pawls 89 stretches the lifting springs 99. Simultaneously with the engagement of the hooks 92 and the hook pins 102, the depressing member 304 of the lifting member 84 contacts the stop pin 100 and the member 84 is turned clockwise, which disengages the recess 85 from the supporting rod 86. On this disengagement, the lifting pawl levers 87 are turned clockwise rapidly by the force of the lifting springs 99. Because the hooks 92 of the lifting pawls 89 are in engagement with the hook pins 102, the pins 102 are also pulled up. The platen lifting levers 101 are turned clockwise quickly and the platen assembly 108 is knocked against the type face 20 of the printing device. See the broken line condition of the platen assembly in FIG. 22.

Immediately prior to completion of the up stroke of the platen assembly 108 against the type face 20, the rear portions 305 of the lifting pawls 89 contact the stop pin 90. The pawls 89 are pivoted clockwise around the shaft 88, and the hooks 92 are disengaged from the hook pins 102. However, the inertia of the moving platen lifting lever 101 knocks the platen assembly 108 against the type face 20. The label 13 of the label strip 12 that is then on the platen assembly 108 can be printed as shown in FIG. 18. The platen assembly 108 is knocked against the type face 20 with a constant printing pressure caused only by the force of the springs 99.

After the printing, the platen lifting levers 101 are returned counterclockwise to their position indicated by solid lines in FIG. 22 by the reaction of the printing stroke and by the tension of the lowering spring 106, because the hooks 92 and hook pins 102 are already disengaged.

Shortly after this, the ink roller 54 is returned by the tension spring 24 along the long grooves 47 to the rearward position under the printing device 1. The feed roller 73 is rotated by the hook 74 to the state shown in FIG. 21. The clearly printed label 13 is applied to the surface of an article by the applicator 7.

Figure 23:
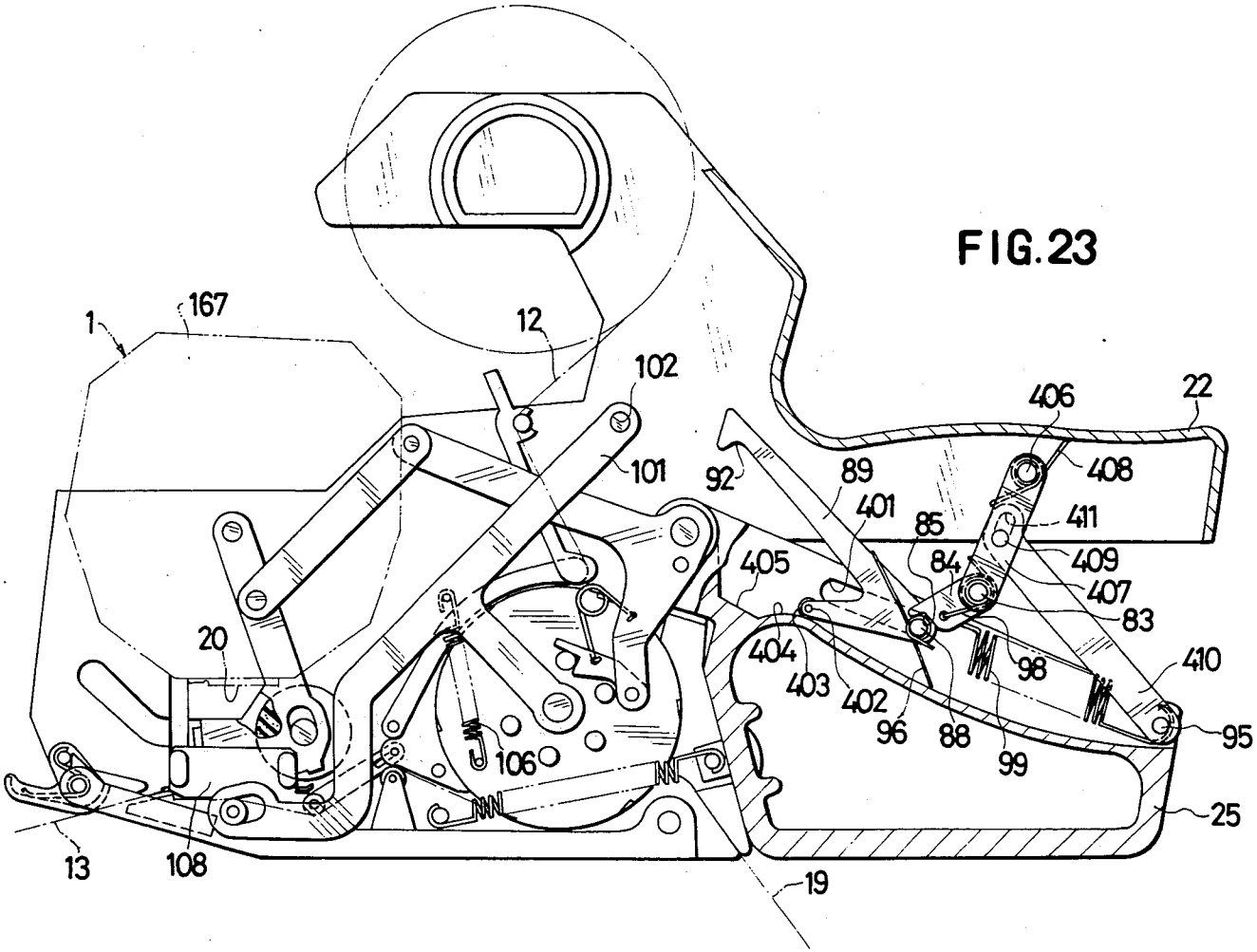
FIG. 23 is the same type of view as FIG. 19 with the labeler containing the fourth embodiment of the constant pressure mechanism.

The fourth embodiment of the present invention is described with reference to FIGS. 23 and 24.

In this embodiment, the platen lifting levers 101 and the platen assembly 108 are similar to those of the first embodiment. However, the lifting pawls 89 and the means for rocking the pawls 89 are different.

The lifting pawls 89 are attached to the lifting pawl shaft 88. Shaft 88 is received in the guide groove 401 which is formed in the upper middle portion of the hand lever 25. A spring 96 on the shaft 88 urges the lifting pawls 89 counterclockwise. A lifting spring 99 is stretched between the lifting pawl shaft 88 and a pin 95 fixed to the rear end of the hand lever 25, whereby the lifting pawls 89 and the shaft 88 are pulled toward the pin 95. The lifting pawls 89 carry a roller 403 which is rotatably supported by a shaft 402 at the lower tip end of the pawls 89. The roller 403 is guided by the curved surface 404 inside the hand lever 25 and, accordingly, the hooks 92 at the upper tips of pawls 89 are rocked by the profile of surface 404. When the rollers 403 ride up the flat upper surface 405 upon squeezing of the hand lever 25, the hook 102 of the platen lifting levers 101 are caught by the hooks 92 on the lifting pawls 89.

A link 407 is attached to a shaft 406 fixed to the grip 22. The lifting member 84 is attached to the link 407 by a shaft 83. On the lower end of the member 84 opposite to the shaft 83, a recess 85 is formed. The lifting member 84 pushes the lifting pawls 89 toward the hook pins 102 when the hand lever 25 is squeezed, by intermediate means described below. The lifting member 84 is urged counterclockwise by a torrsion spring 98 wound around the shaft 83. The lifting member 84 is also pulled rearward. The link 407 is also urged counterclockwise by a torsion spring 408 wound around the shaft 406 in the grip 22. The recess 85 thus engages the lifting pawl shaft 88.

In order to push the lifting pawls 89 toward the hook pins 102 by means of the lifting member 84 and the link 407, another link 410 is attached between the pin 409, which is affixed at the middle portion of the link 407, and the pin 95 at the rear end of the hand lever 25. This pin 409 is fitted into the elongated slot 411 of the link 410. When the link 407 is rocked, the pin 409 slides within the slot 411.

When the hand lever 25 is squeezed toward the grip 22, the type face 20 of the printing device 1 is inked in like manner as in the foregoing embodiments.

The link 410 rotates counterclockwise around the pin 95, the link 407 pivots clockwise around the shaft 406, and the lifting member 84 moves toward the hook pins 102 on the platen lifting levers 101. Because the recess 85 of the lifting member 84 is in engagement with the lifting pawl shaft 88, the lifting pawls 89 are also moved toward the hook pins 102 against the force of the lifting spring 99.

Figure 24:
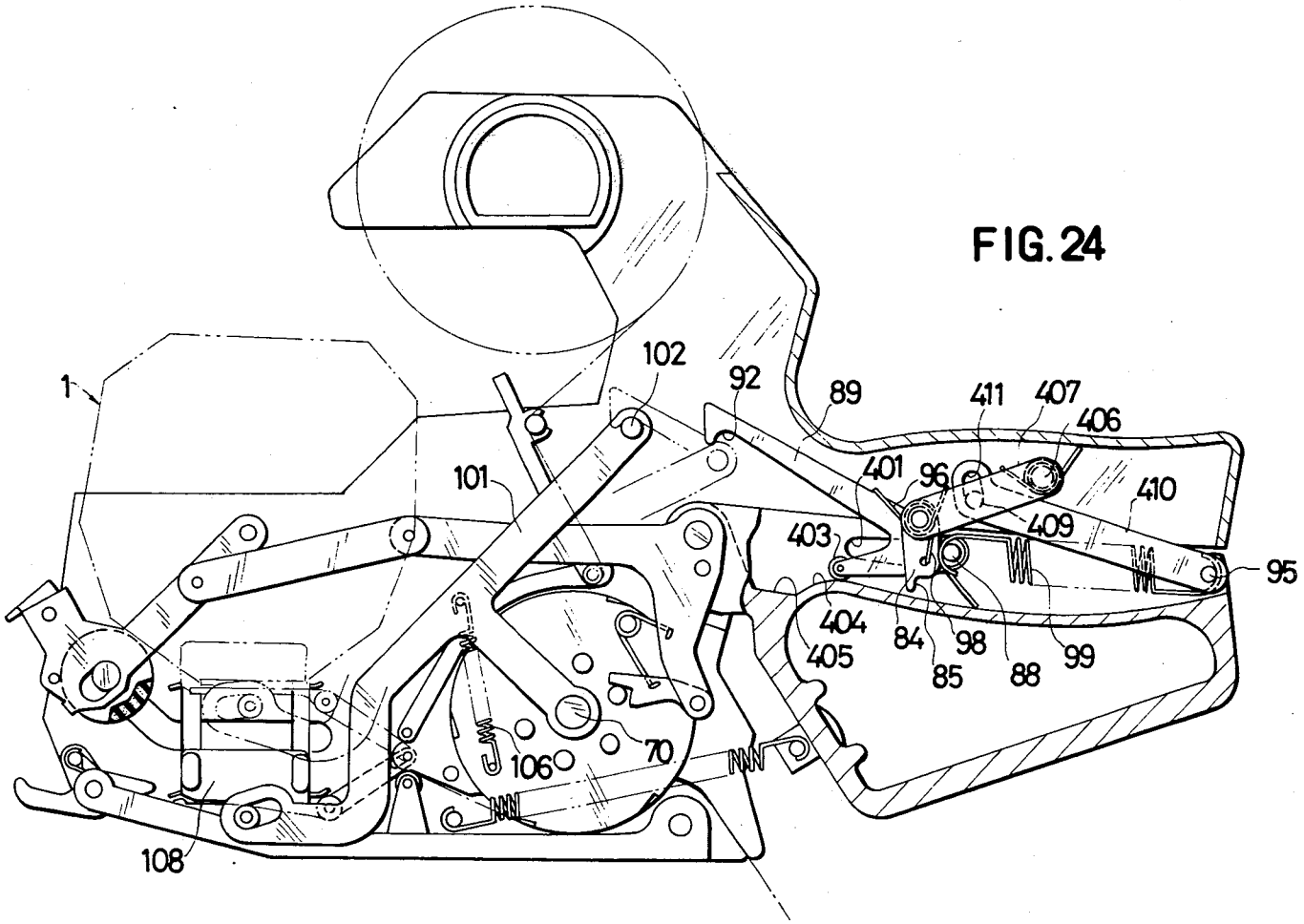
FIG. 24 is the same view as FIG. 23, wherein the hand lever has been squeezed.

Just before the roller 403 reaches the flat surface 405, the lifting pawls 89 are pivoted counterclockwise and the hooks 92 are caught by the hook pins 102, as shown in broken lines in FIG. 24. Simultaneously with this action, the recess 85 of the lifting member 84 disengages from the lifting pawl shaft 88. The lifting pawls 89 are freed and are immediately pulled rearward by the spring 99. The platen lifting levers 101 are turned clockwise when the retracting hooks 92 of the lifting pawls 89 are in engagement with the hook pins 102. The platen assembly 108 is knocked against the type face and the label strip 12 on the platen assembly 108 is printed.

Just before this printing stroke, the lifting pawls 89 are turned clockwise by the shape of profiled surface 404 and the hooks 92 disengage from the hook pins 102. However, printing still can be attained because the platen assembly 108 continues to move toward and against the type face 20 under the inertia of assembly 108. As the hooks 92 of the lifting pawls 89 have disengaged from hook pins 102 just before the moment of printing, the platen lifting levers 101 are returned counterclockwise by the reaction of the printing stroke and by the force of the spring 106. The parts reassume the state shown in solid lines in FIG. 24. When the hand lever 25 is then released, the lifting member 84 also returns to the state shown in FIG. 23.

Like the foregoing embodiments, the platen assembly 108 is knocked against the type face 20 with constant pressure. Therefore, the label 13 of the label strip 12 which is then on the platen assembly 108 can be always printed clearly and precisely.

The fifth embodiment of the constant printing pressure mechanism is explained with reference to FIGS. 25 and 26. In this embodiment, the grip 22 is formed at the upper middle portion of the machine body and the hand lever 25 is pivotally attached on the shaft 23 which is affixed to the grip 22. The inking device 4 is driven by the drive levers 29 which are attached to the front end of the hand lever 25. The constant pressure mechanism 3 positioned under the hand lever 25 is actuated by the rear driving levers 501 connected to the rear end of the hand lever 25.

The constant pressure mechanism 3 comprises push up levers 76, which correspond to the first lifting pawl levers in the first embodiment, lifting member 84, lifting pawl levers 87 which correspond to the second lifting pawl levers in the first embodiment, lifting pawls 89, lifting springs 99, platen lifting levers 101, platen assembly 108 and vertical grooves 117 to guide the platen assembly 108 to the type face 20. The front ends of the push up levers 76 are attached to the shaft 81, which is attached to the machine frame 21. The rear ends of levers 76 have slots 502 which receive therein the connecting pins 503 of the driving levers 501. Further, the supporting shaft 83 which is attached in the middle portion of the levers 76 pivotally supports the lower end of the lifting member 84. The lifting member 84 has a recess 85 at its upper end. It is urged counterclockwise by the spring 98 that is stretched between the pin 97 of the lifting member 84 and other pin 95' on the lifting pawl lever 87. In the usual situation, with the hand lever 25 released, the recess 85 engages the supporting rod 86 attached to the lifting pawl levers 87.

The lower ends of the lifting pawl levers 87 are pivotally attached to the shaft 81. The upper ends of levers 87 support the lifting pawls 89 and they are pivotally connected by the lifting pawl shaft 88. Further, the lifting pawl levers 87 are urged clockwise by the spring 99 which is attached between the lifting pawl shaft 88 and the spring pin 95 affixed on the rear portion of the machine frame 21. In their usual state, levers 87 rest against the first stop pin 100 which is attached at the middle portion of the machine frame 21.

The lifting pawls 89 have a rear inclined surface 91 on their upper rear portion, have a front inclined surface 93 and have a hook 92 at their front portions. Further, the lifting pawls 89 are urged counterclockwise around shaft 88 by the spring 96 which is stretched between the pin 95' on the lifting pawl levers 87 and the pin 94 on the lifting pawls 89. In the usual state, the rear inclined surfaces 91 rest against the second stop pin 90, which is affixed on the machine frame 21.

The platen lifting levers 101 are positioned in front of the above mentioned push-up levers 76. Levers 101 are L-shaped. They are pivotally supported by the fixedly positioned shaft 81. Each platen lifting lever 101 has a hook pin 102 at its upper end. The slot 107 formed at its opposite end receives the ring 119 which is fitted on the pin 118 that projects from the side wall of the platen assembly 108. Further, the platen lifting levers 101 are normally urged counterclockwise by a tensioned spring 106 that is stretched between the pin 176 on the projection 504 of lever 101 and the pin 175 affixed to the machine frame 21.

The advancing mechanism 5 is driven by the hooks 74 that are connected to the driving lever 501.

When the hand lever 25 is squeezed, the inking device 4 is moved by the driving levers 29 and this inks the type face 20 of the printing device 1.

At the same time, the constant pressure mechanism 3 is actuated by the rear driving lever 501. The rear driving lever 501 is raised, which rotates the push up levers 76 counterclockwise about the shaft 81. The recess 85 of the rising lifting member 84 pushes up the supporting rod 86 and this turns the lifting pawl levers 87 counterclockwise around the shaft 81. Such motion of the lifting pawl levers moves the lifting pawls 89 forward until their front inclined surfaces 93 contact the hook pins 102. This pivots the lifting pawls 89 clockwise around the shaft 88, which causes the hooks 92 to engage the hook pins 102. The lifting spring 99 is simultaneously stretched.

When the hooks 92 engage the hook pins 102, the front surface of the lifting member 84 contacts the first stop pin 100 and the member 84 rotates clockwise. When the rear driving lever 501 is raised further, the supporting rod 86 disengages from the recess 85. The lifting pawls 89 in engagement with the hook pins 102 are rapidly pulled by the tension of the lifting spring 99. The pawls 89 are rapidly rotated clockwise together with the platen lifting levers 101. This raises platen assembly 108 along the vertical grooves 117.

The inertia of the rapid motion of the platen lifting levers 101 and of the platen assembly 108 causes the assembly 108 to knock against the type face 20. Thus, the label 13 of the label strip 12 which is then on the platen assembly 108 is printed by the contact with the type face 20.

When the rear inclined surfaces 91 of the lifting pawls 89 contact the second stop pin 90, the hooks 92 are raised off the hook pins 102. The platen lifting levers 101 are returned counterclockwise by the reaction to the printing stroke and by the tension of the spring 106.

In this step, the front surface of the lifting member 84 is pushed rearward by the rod 86 and the lifting pawl levers 87 are stopped by the engagement of their rear edges with the first stop pin 100.

When the hand lever 25 is released after the descent of the platen assembly 108, the rear driving lever 501 is lowered, the push up levers 76 pivot clockwise, and the lifting member 84 is thus returned in contact with the supporting rod 86. When the lifting member 84 has completely moved back, the recess 85 thereof comes into engagement with the supporting rod 86.

As in the foregoing embodiments, when the hand lever 25 of this embodiment is squeezed, the platen assembly 108 is knocked against the type face 20 with a constant pressure. Thus, clear and precise printing can be always applied to the labels 13.

There can be several modifications of the fifth embodiment. For example, the platen lifting levers 101 could be vertically moved by some link mechanism and the platen assembly would be firmly attached to said lever; or a trigger parallel to the grip could be used in place of the hand lever.

Figure 27:
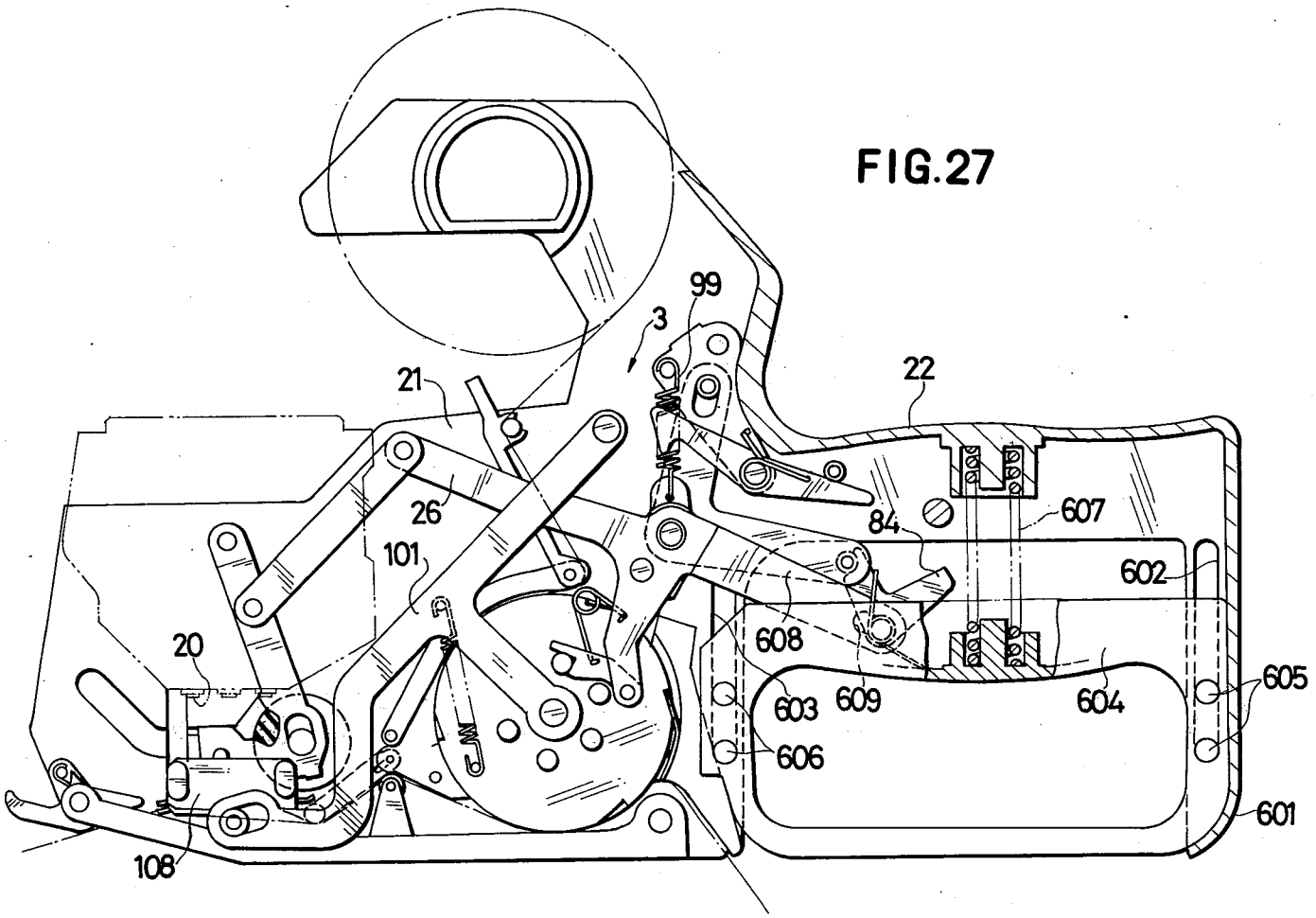
FIG. 27 is the same type of view as FIG. 19 with the labeler containing the sixth embodiment of the constant pressure mechanism.
Figure 28:
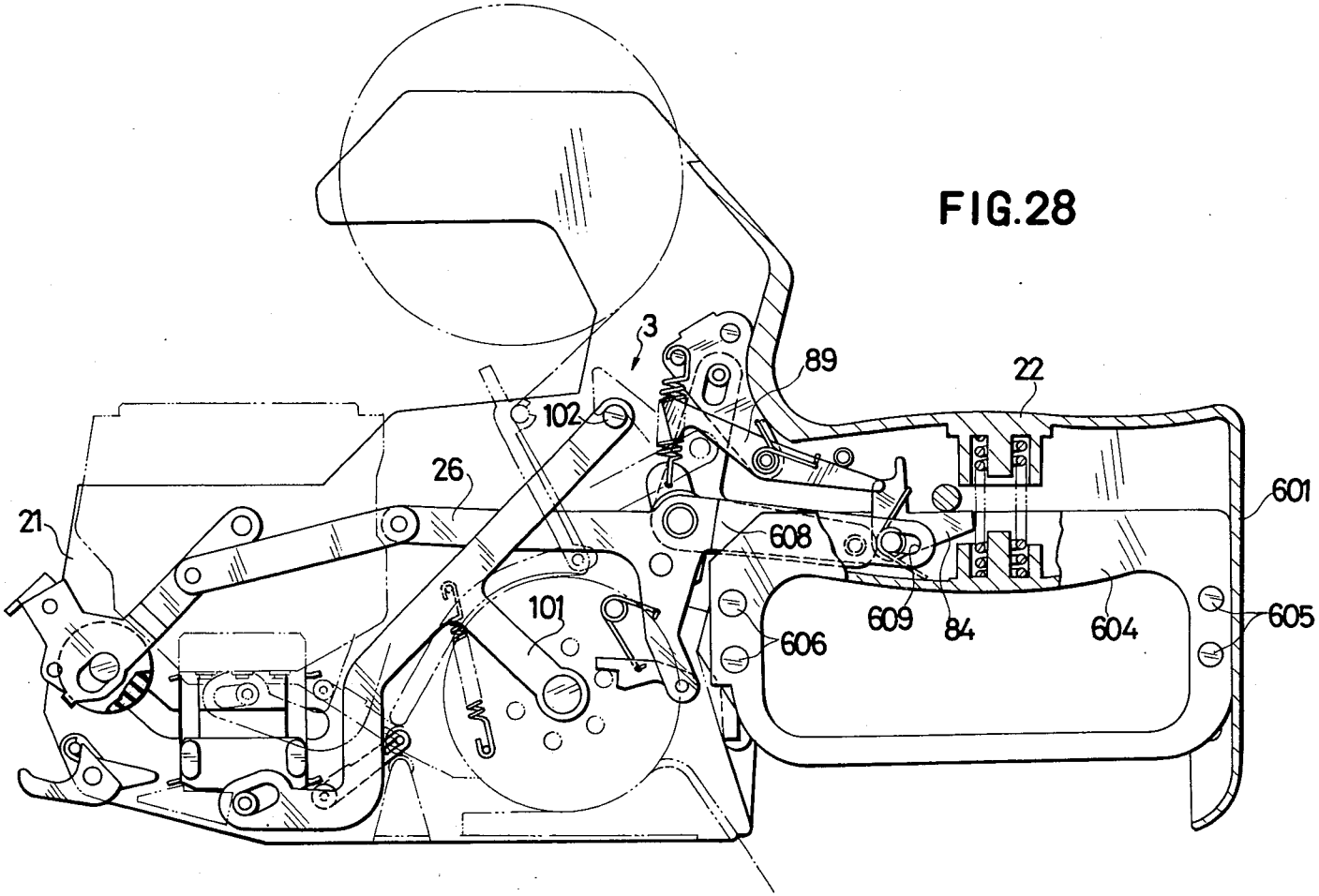
FIG. 28 is the same view as FIG. 27, wherein the hand lever has been squeezed.

The sixth embodiment has such a parallel trigger moving in a vertical direction and it is described with reference to FIGS. 27 and 28.

In this embodiment, the constant pressure mechanism 1 is almost the same as in the first embodiment, so that only the different parts will be explained. The machine frame 21 has the integral grip 22. The rear end of the grip 22 is provided with an integral vertical support 601. Vertical slots 602 are formed on the inside surfaces of the vertical support 601. The machine frame 21 has other vertical slots 603. The trigger 604 has guide pins 605 which engage in the grooves 602 at the rear of the frame and has another set of guide pins 606 which engage in the front grooves 603. The trigger 604 is vertically moved through grooves 602, 603 maintaining its parallel relation with the grip 22. The trigger 604 is urged away from the grip 22 by a compression spring 607 interposed between them.

The yoke 26 is a separate part from the trigger 604 instead of being an extension of it. The yoke 26 includes rearwardly extending levers 608, which extend to the trigger 604. The levers 608 have slots 609 at the rear ends to absorb the relative motion to which levers 609 are subjected. The lifting member 84 which drives the constant pressure mechanism 3 is attached at said slots 609.

The sixth embodiment operates in the same manner as the other embodiments and clear printing with constant pressure can be attained.

As explained in the above, the hand labeler of the present invention prints the labels as shown in FIG. 18, such as visually readable labels used in various stores and supermarkets and also optical reader readable labels carrying OCR letters or bar codes, used in a POS system.

Further, in the present invention, the platen carrying the label strip to be imprinted is caused to knock against the type face with a constant printing pressure. The strength and duration of the printing stroke of the platen are not varied, no matter how strongly or quickly the hand lever or the trigger is squeezed. Immediately after the printing stroke, the label is separated from the type face. Therefore, clear and precise printing on the labels can be attained without fail.

Further, since clarity and precision of printing are especially required in the case of optically read labels carrying OCR letters or bar codes, the constant pressure mechanism of the present invention is most suitable for such purposes.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

I claim:

1. A hand labeler comprising:

a frame;

a printing device fixedly mounted on said frame;

a platen assembly for carrying a label strip, and supported in said frame and positioned such that a label on said platen assembly confronts said printing device;

a hand lever for being operated to move said platen assembly; platen assembly operating means for operatively connecting said hand lever and said platen assembly and for rapidly moving said platen assembly against said printing device with the label on said platen assembly; biasing means connected with said platen assembly operating means for causing said platen assembly operating means to rapidly move said platen assembly with a constant printing pressure against said printing device; said biasing means being connected with said hand lever for being charged by movement of said hand lever and for thereafter being released to discharge and cause said platen assembly operating means to move said platen assembly following further movement of said hand lever;

means for retracting said platen assembly from said printing device; disconnect means for disconnecting said biasing means from said platen assembly operating means prior to said retracting means retracting said platen assembly.

2. The hand labeler of claim 1, wherein said platen assembly comprises a platen and a platen lifting lever on which said platen is supported; said retracting means normally biasing said platen away from said printing device;

said hand lever including an actuating lever;

said platen assembly operating means comprise a platen lifting lever engagement piece which on the one hand is engageable with said actuating lever and which on the other hand is movable toward said platen lifting lever, and said platen lifting lever including engageable means thereon for being engaged by said engagement piece, said engagement piece and said engageable means being spaced apart such that said engagement piece engages said engageable means only. after said engagement piece has been shifted by said actuating lever;

said biasing means being connected with said engageable piece so as to draw said engagement piece back against the direction it is moved by said actuating lever after said engagement piece is disengaged from said actuating lever; means for disengaging said engagement piece from said actuating lever after said engagement piece engages said engageable means on said platen lifting lever;

said disconnect means comprising means for disengaging said engagement piece from said engageable means when said engagement piece has returned toward its initial position under the bias of said biasing means.

3. A hand labeler comprising:

a platen:

means for feeding labels to be printed onto said platen;

a print head having a print surface facing toward said platen;

a constant printing pressure mechanism for moving said platen to contact a label on said platen against said print surface; said constant printing pressure mechanism comprising:

a platen lifting lever; said platen being secured to said lifting lever; said platen lifting lever being shiftable to shift said platen toward and away from said print surface; first engagement means on said platen lifting lever which, when they are engaged, enables said platen lifting lever to shift said platen toward said print surface;

second engagement means movable toward and away from said first engagement means and engageable with said first engagement means; biasing means connected with said second engagement means for biasing said second engagement means to move said platen lifting lever to shift said platen to said print surface when said second engagement means and said first engagement means are engaged;

whereby printing by said print surface on said labeler is caused by said second engagement means biasing means moving said platen toward said print surface;

an actuating lever movable between a gripped and a released position;

a lifting member operatively connected to said actuating lever to be moved thereby as said actuating lever is moved toward said gripped position; said lifting member being separably connected to said second engagement means for moving said second engagement means toward said first engagement means as said actuating lever moves to said gripped position;

lifting member release means in said labeler and positioned to be engaged by said lifting member about when said first engagement means and said second engagement means have been engaged, for the purpose of separating said lifting member from said second engagement means, thereby permitting said second engagement means to be biased by said biasing means to raise said platen to said print surface.

4. The hand labeler of claim 3, further comprising an inking device for inking said printing surface; said inking device being connected with said actuating lever for being moved thereby to ink said printing surface.

5. The hand labeler of claim 4, further comprising a device attached to said machine frame for applying printed labels to another object; a device for moving printed labels off said platen and for delivering them to said applying device.

6. The hand labeler of claim 3, further comprising a guiding linkage to which said second engagement means is connected; a first pivot mount on said frame; said guiding linkage being pivotally attached to said first pivot mount; said second engagement means being connected to said guiding linkage at a location spaced from said first pivot mount, whereby pivoting of said guiding linkage shifts said second engagement means.

7. The hand labeler of claim 6, wherein said guiding linkage comprises a first link pivotally mounted to said frame and engageable by said lifting member as said actuating lever is operated, whereby said first link is pivoted by said lifting member;

a second link, pivotally connected to said first link and said second link being the part of said guiding linkage which is pivotally attached to said first pivot mount, whereby as said first link pivots, it pivots said second link about said first pivot mount; said second engagement means being pivotally connected to said guiding linkage at said second link; said biasing means being connected to said second link for pivoting said second link in a direction that moves said second engagement means to raise said platen.

8. The hand labeler of claim 6, wherein said guiding linkage comprises an arm pivotally mounted to said frame and engageable by said lifting member as said actuating lever is operated, thereby to pivot said arm.

9. The hand labeler of claim 8, further comprising a second pivot mount on said frame; said platen lever being pivotally supported on said second pivot mount, whereby said platen pivots toward and away from said print surface;

said arm of said guiding linkage being pivotally mounted to said frame at said second pivot mount.

10. The hand labeler of claim 9, wherein said guiding linkage comprises a first link which is the part of said guiding linkage that is pivotally connected to said first pivot mount; said lifting member being pivotally connected to said first link at a location spaced from said first pivot mount; a second link pivotally connected to said first link between said first pivot mount and the connection to said lifting member and also being pivotally connected to said actuating lever, whereby as said actuating lever is gripped, said second link pivots said first link to move said lifting member to move said second engagement means.

11. The hand labeler of claim 6, further comprising a second pivot mount on said frame; said actuating lever being pivotally attached to said frame at said second pivot mount; pivoting of said actuating lever, through said lifting member, pivots said second engagement means guiding linkage.

12. The hand labeler of claim 11, further comprising a third pivot mount on said actuating lever; said lifting member comprising an arm pivotally connected to said actuating lever at said third pivot mount thereon; a recess on said lifting member arm;

an abutment on said guiding linkage for said second engagement means and positioned to be received in said recess; biasing means for biasing said lifting member toward said abutment and for holding said abutment in said recess, whereby motion of said lifting member to move said second engagement means toward said first engagement means has said abutment in engagement with said recess correspondingly moving.

13. The hand labeler of claim 6, wherein said second engagement means is pivotally connected to its said guiding linkage, whereby said second engagement means may move along the pathway followed by said first engagement means as said guiding linkage pivots.

14. The hand labeler of claim 13, further comprising second biasing means for said second engagement means to bias said second engagement means to remain in engagement with said first engagement means once they are in engagement.

15. The hand labeler of claim 3, further comprising second engagement means release means in said labeler and positioned to be engaged by said second engagement means as said second engagement means has moved under the influence of said biasing means to a position which enables said platen to move a label thereon against said print surface; upon engagement of said second engagement means release means and said second engagement means, said second engagement means release means then moving said second engagement means to separate from said first engagement means.

16. The hand labeler of claim 15, further comprising platen lever biasing means for biasing said platen lever away from said print surface following contact of a label on said platen with said print surface.

17. The hand labeler of claim 15, further comprising a guiding linkage to which said second engagement means is connected; a first pivot mount on said frame; said guiding linkage being pivotally attached to said first pivot mount; said second engagement means being connected to said guiding linkage at a location spaced from said first pivot mount, whereby pivoting of said guiding linkage shifts said second engagement means.

18. The hand labeler of claim 15, wherein said labeler includes a frame to which the elements of said labeler are connected.

19. The hand labeler of claim 18, wherein said second engagement means release means comprises an abutment on said frame which is engaged by said second engagement means.

20. The hand labeler of claim 19, wherein said second engagement means release means is so positioned on said labeler frame as to separate said second engagement means from said first engagement means just prior to the movement by said platen of the label on said platen against said print surface.

21. The hand labeler of claim 18, further comprising a first pivot mount on said frame; said platen lever being pivotally supported on said first pivot mount, whereby said platen pivots toward and away from said print surface.

22. The hand labeler of claim 21, further comprising said actuating lever including a profiled surface therein; said second engagement means being continuously in engagement with said profiled surface of said actuating lever; said lifting member being in engagement with said second engagement means to move said second engagement means along said actuating lever profiled surface as said actuating lever is gripped;

said second engagement means release means comprises a profiled first portion of said actuating lever profiled surface which is so placed and shaped that said second engagement means is caused to separate from said first engagement means when said second engagement means passes over that said first portion of said profiled surface;

said means in said labeler for shifting said hooking means to hook said hookable means comprises a second profiled portion of said actuating lever profiled surface which is so placed and shaped as to cause said hooking means to move to hook said hookable means when said second engagement means is at said second section of said profiled surface.

23. The hand labeler of claim 21, further comprising a second pivot mount on said frame; said actuating lever being pivotally attached to said frame at said second pivot mount; pivoting of said actuating lever, through said lifting member moves said second engagement means to said first engagement means.

24. The hand labeler of claim 23, further comprising a third pivot mount on said actuating lever; said lifting member comprising an arm pivotally connected to said actuating lever at said third pivot mount thereon; a recess on said lifting member arm;

an abutment on said guiding linkage for said second engagement means and positioned to be received in said recess; biasing means for biasing said lifting member toward said abutment and for holding said abutment in said recess, whereby motion of said lifting member to move said second engagement means toward said first engagement means has said abutment in engagement with said recess correspondingly moving.

25. The hand labeler of claim 24, further comprising second biasing means for said second engagement means to bias said second engagement means to remain in engagement with said first engagement means once they are in engagement;

said second engagement means release means being so positioned as to shift said second engagement means against the normal bias of said second engagement means second biasing means, thereby to separate said second engagement means from said first engagement means.

26. The hand labeler of claim 23, wherein said first engagement means comprises a hookable means on said platen lifting lever and said second engagement means comprises a hooking means which is adapted to contact and hook said hookable means.

27. The hand labeler of claim 26, further comprising means in said labeler for shifting said hooking means to hook said hookable means when they come into engagement as said guiding linkage moves said hooking means against said hookable means.

28. The hand labeler of claim 27, wherein said hookable means comprises a pin on said platen lifting lever and said hooking means comprises a hook which is hookable over said hookable means pin.

29. The hand labeler of claim 26, further comprising platen lever biasing means for biasing said platen lever away from said print surface following contact of a label on said platen with said print surface.

30. The hand labeler of claim 29, wherein said labeler includes a frame to which the elements of said labeler are connected.

31. The hand labeler of claim 30, further comprising a guiding linkage to which said second engagement means is connected; a first pivot mount on said frame; said guiding linkage being pivotally attached to said first pivot mount; said second engagement means being connected to said guiding linkage at a location spaced from said first pivot mount, whereby pivoting of said guiding linkage shifts said second engagement means.

* * * * *